US009796503B2

(12) United States Patent
Gabrys

(10) Patent No.: US 9,796,503 B2
(45) Date of Patent: Oct. 24, 2017

(54) CORRUGATED SKID

(71) Applicant: Christopher W. Gabrys, Reno, NV (US)

(72) Inventor: Christopher W. Gabrys, Reno, NV (US)

( * ) Notice: Subject to any disclaimer, the term of this patent is extended or adjusted under 35 U.S.C. 154(b) by 0 days.

(21) Appl. No.: 14/999,860

(22) Filed: Jul. 11, 2016

(65) Prior Publication Data

US 2017/0015463 A1 Jan. 19, 2017

Related U.S. Application Data

(60) Provisional application No. 62/193,727, filed on Jul. 17, 2015, provisional application No. 62/205,087, filed on Aug. 14, 2015, provisional application No. 62/306,612, filed on Mar. 10, 2016.

(51) Int. Cl.
*B65D 19/00* (2006.01)
*B65D 19/44* (2006.01)
*B65D 73/00* (2006.01)

(52) U.S. Cl.
CPC ..... *B65D 19/0012* (2013.01); *B65D 19/44* (2013.01); *B65D 73/0042* (2013.01); *B65D 2519/00019* (2013.01); *B65D 2519/00054* (2013.01); *B65D 2519/0081* (2013.01); *B65D 2519/00273* (2013.01); *B65D 2519/00288* (2013.01); *B65D 2519/00318* (2013.01); *B65D 2519/00567* (2013.01); *B65D 2519/00796* (2013.01)

(58) Field of Classification Search
CPC ..... B65D 19/20; B65D 2519/00562; B65D 2519/00019; B65D 2519/0057
USPC ..... 108/51.3, 51.11, 57.26, 56.1, 901, 902
See application file for complete search history.

(56) References Cited

U.S. PATENT DOCUMENTS 2,696,356 A * 12/1954 Baumann ..... B65D 19/0016 108/51.3
2,856,826 A * 10/1958 Norquist ..... B31D 5/00 493/417
2,908,464 A * 10/1959 Traudt ..... B65D 19/0012 108/51.3
2,951,669 A * 9/1960 Davidson ..... B65D 5/5035 108/51.3
3,308,772 A * 3/1967 Thomas, Jr. ..... B65D 19/0026 108/51.3

(Continued)

FOREIGN PATENT DOCUMENTS

DE 4307515 A1 9/1994

*Primary Examiner* — Jose V Chen
(74) *Attorney, Agent, or Firm* — J. Michael Neary

(57) ABSTRACT

A skid for moving and shipping goods in bulk includes top and bottom die-cut blanks of corrugated material that are each folded along score lines to produce two or more double-thickness ribs. Notches cut across the crest of the ribs in the top blank, and slots cut in the bottom blank on both sides of, and part way into the ribs enable the ribs of the top blank to be inserted through the slots in the bottom blank so the top and bottom blanks are brought together face-to-face producing a double thickness deck. The notches and slots of the top and bottom blank ribs are interlocked to lock the ribs in folded, closed position. The ribs protrude from the double-thickness deck of the skid and contact the floor to support the skid deck and its load of goods above the floor for easy access by forked moving equipment.

20 Claims, 22 Drawing Sheets

(56) References Cited

U.S. PATENT DOCUMENTS 3,464,370 A * 9/1969 Martin ..... B65D 19/0024 108/51.3
3,520,258 A * 7/1970 Shepherd ..... B65D 19/0012 108/51.3
3,911,834 A 10/1975 Quaintance
4,185,565 A * 1/1980 Nymoen ..... B65D 19/0016 108/51.3
4,875,419 A * 10/1989 Helton ..... B65D 19/0012 108/51.3
4,936,229 A * 6/1990 Parnell ..... B65D 19/0012 108/51.3
4,979,446 A 12/1990 Winebarger
5,176,090 A * 1/1993 Roberts ..... B65D 19/0026 108/51.3
5,207,631 A * 5/1993 Schmidtke ..... B31D 5/00 108/51.3
5,218,913 A * 6/1993 Winebarger ..... B65D 19/0024 108/51.3
5,337,679 A * 8/1994 Moorman ..... B65D 19/0026 108/51.3
5,337,680 A * 8/1994 Johnston ..... B65D 19/0026 108/51.3
5,350,066 A * 9/1994 Mendoza ..... B65D 19/20 108/51.3
5,357,875 A * 10/1994 Winebarger ..... B65D 19/0024 108/51.3
5,377,600 A 1/1995 Speese et al.
5,383,409 A * 1/1995 Hayakawa ..... B65D 19/0016 108/51.3
5,427,019 A * 6/1995 Moorman ..... B65D 19/0026 108/51.3
5,452,667 A * 9/1995 Lim ..... B65D 19/0012 108/51.3
5,528,995 A * 6/1996 Lim ..... B65D 19/0012 108/51.3
5,701,827 A * 12/1997 Urabe ..... B65D 19/0012 108/180
5,784,971 A * 7/1998 Chang ..... B65D 19/0059 108/51.3
6,116,568 A * 9/2000 Rosenblat ..... B28B 7/28 229/120.17
7,000,549 B2 * 2/2006 Nelson ..... B65D 19/0012 108/51.3
7,007,613 B2 * 3/2006 Sketo ..... B65D 19/0012 108/51.3
7,426,890 B2 * 9/2008 Olvey ..... B65D 19/0036 108/51.3
8,291,836 B2 * 10/2012 Jian ..... B65D 19/0028 108/51.3
2007/0283856 A1 * 12/2007 Berghmans ..... B32B 5/18 108/51.3

* cited by examiner

CORRUGATED SKID

This application is related to U.S. Provisional Application Nos. 62/193,727 filed on Jul. 17, 2015; 62/205,087 filed on Aug. 14, 2015; and 62/306,612 filed on Mar. 10, 2016.

This invention pertains to pallets and skids for shipping goods, and more particularly to a corrugated skid comprising two pieces of corrugated sheets that fold together. The skid provides sufficient load support for the majority of shipments while minimizing the required amount of corrugated board for lower material costs. The corrugated skid utilizes no bottom deck and is uniquely constructed allowing rapid assembly.

BACKGROUND OF THE INVENTION

Pallets are said to move the world. Eighty percent of commerce ships on pallets. The pallet industry is estimated at greater than $30 B worldwide. More than 500 million pallets are manufactured in the US each year, with 1.8 billion pallets in service in the US alone. Pallets can be made from various materials, however wood pallets currently comprise about 80% of the market. More than 40% of worldwide hardwood lumber currently goes toward the manufacturing of wood pallets. Other materials used for pallet manufacturing include plastic, metal and corrugated paperboard.

Recent regulations regarding infestation and contamination are creating a surge in interest and use of non-wood pallet alternatives. A small, but fast growing segment is the use of corrugated paperboard pallets. Many desire to replace conventional wooden pallets with corrugated pallets for reducing costs, increasing ability to recycle, lowering pallet weight, eliminating product contamination, reducing pallet storage volume and reducing pallet related injuries.

Many different designs of corrugated paperboard pallets have been developed to date. Despite the potential advantages of corrugated pallets, many have suffered from several different deficiencies. These deficiencies include low strength and stiffness, high use of corrugated paperboard, resulting in higher material costs, warehouse space, assembly labor and freight costs. The inherent inability to readily produce and distribute corrugated pallets in sufficiently high volume has also been a critical factor in the commercial failures of almost all prior art corrugated paperboard pallets.

In some applications, material handing is conducted using stacker type forklifts that have front roller forks as well as lifting forks. Stacker forklifts have the advantages of being smaller and more maneuverable than conventional type forklifts, and are lower cost. Unfortunately, the front roller forks preclude the use of pallets or other load-supporting platforms having a bottom deck.

Accordingly, a new corrugated skid is needed that can be easily and rapidly produced that uses the minimal amount of corrugated board, is strong and lightweight, and is fully recyclable, so it can be used once and then recycled. This would eliminate the costly reshipment of used pallets or skids back to the shipper, and would also eliminate the problems of contamination and infestation. The light weight of such a novel skid would greatly reduce the shipping costs of goods, particularly in the case of air shipments, at an overall cost significantly less than the use of conventional pallets and skids, even those made of corrugated material. Ideally, such a novel skid could be shipped to a user in the form of stacks of flat blank that could be rapidly assembled as needed at point of use without the need for large volumes of storage space to accommodate assembled pallets or skids.

SUMMARY OF THE INVENTION

Accordingly, this invention provides a strong and light weight skid for shipping goods. It is made of two die-cut blanks of corrugated material that are quickly and easily assembled together with minimal corrugated board use. The corrugated material can be corrugated paperboard or alternative types such as corrugated plastic, including corrugated polypropylene, which is sold widely under the trade name of Coroplast. The invention provides the benefits of durability from a double thickness upper deck and double thickness vertical support ribs that are mechanically folded and locked together. The skid may also be constructed from only two flat blanks that can be assembled together without adhesive when desired.

In a preferred embodiment of the invention, the two die cut blanks form a deck having at least an upper layer and a lower layer. If additional strength and stiffness is desired for loads that are significantly heavier and unevenly distributed, an additional deck sheet can be used. The upper layer forms an upper surface of the deck, and at least two double layer ribs are folded on fold lines from the upper layer blank and extend vertically toward the lower layer blank. Notches in the upper layer blank are provided across the centerline of the portion that forms the upper layer ribs. Double thickness ribs are likewise folded from the lower layer blank and extend away from the upper layer blank. Slots in the lower layer allow the ribs in the upper layer blank to protrude through the lower layer. The slots are cut in the lower layer blank running from the deck area and extending part way into the lower layer rib area. When the upper and lower layers are brought together face-to-face, the notches in the upper layer ribs inter-engage with the notches in the lower layer ribs to lock each of the upper layer and lower layer ribs in a closed position, forming the deck of the skid having an upper surface capable of supporting a load above a supporting surface, and the ribs extend from an under surface of the deck and terminate equidistance from the undersurface so they support said deck level on a level supporting surface.

A refinement of the preferred embodiment is that the double thickness ribs from the two layers project from the deck in the same direction, and intersect perpendicularly with each other, thereby providing resistance to wracking for said skid when subjected to lateral forces against the deck. This provides additional strength and stability for preferred embodiments of the inventive skid.

The ribs on both layers can each have a root at the junction to their respective blank in the deck, and a free end at the end opposite the root. At the free end, each rib can terminate in a folded-over foot that contacts the supporting surface.

The notch in the top layer rib opens in the foot of that rib, and the slot in the rib on the bottom layer opens in the root of that rib. This arrangement makes the assembly of the skid very easy and quick, and makes it easy to ensure that all the ribs contact the supporting surface for maximum utilization of the ribs for support of the deck and the load carried by the deck.

In a further refinement of the invention, a preferred embodiment includes a plurality of lock receptacles in the lower layer, and a plurality of locking tabs in the upper layer blank aligned with corresponding positions of the locking receptacles in the lower layer when the ribs have been formed and the upper and lower layers are aligned for assembly. The tabs have shoulders that engage the underside of said the lower layer around margins of the locking receptacles when the locking tabs are pushed through the locking receptacles after the ribs of said the upper and lower layers have nested with the slots and notches interlocked. The locking tabs hold the upper and lower layers together, enhancing the strength and stiffness of the deck.

In addition to, or in place of, the locking tabs and receptacles, the upper and lower layers of the deck can be adhered together to greatly increase the strength and stiffness of the deck. The adhesive can be a liquid composition applied to one or both facing surfaces of the deck before assembly, or it can be a pressure sensitive adhesive in the form of double-faced tape, or a contact adhesive. Other types of adhesives can be used, such as adhesives that are applied and then later activated after assembly by heat, microwaves or other processes. The adhesive can be selectively applied to certain areas or can be widely applied, as by spraying.

The skid preferably has fork passages that enable forks of lifting equipment such as fork lifts or pallet jacks to extend under the skid through the fork passages so the skid can be lifted and moved or stacked. Two-sided fork passages can be provided by two cut-outs in portions of the first blank where the ribs are formed, making the ribs into three discontinuous sections and providing openings between the rib sections for fork passages parallel to and between the set of ribs in the second blank.

Four-sided fork passages can be provided for enabling the skid to be picked up by forked lifting equipment from any of four different directions. Two-sided fork passages are provided, as noted above. If fork passages are desired on the other two orthogonal sides, they can be provided in a similar way by another two cut-outs in portions of the second blank where the ribs are formed, making the second blank ribs three discontinuous sections or semi-discontinuous sections, and providing openings between the rib sections for fork passages parallel to and between the set of ribs m the first blank.

DESCRIPTION OF THE DRAWINGS

The invention and its many advantages and features will become better understood upon reading the following detailed description of the preferred embodiments in conjunction with the following drawings, wherein.

DESCRIPTION OF THE PREFERRED EMBODIMENT

Figure 1:
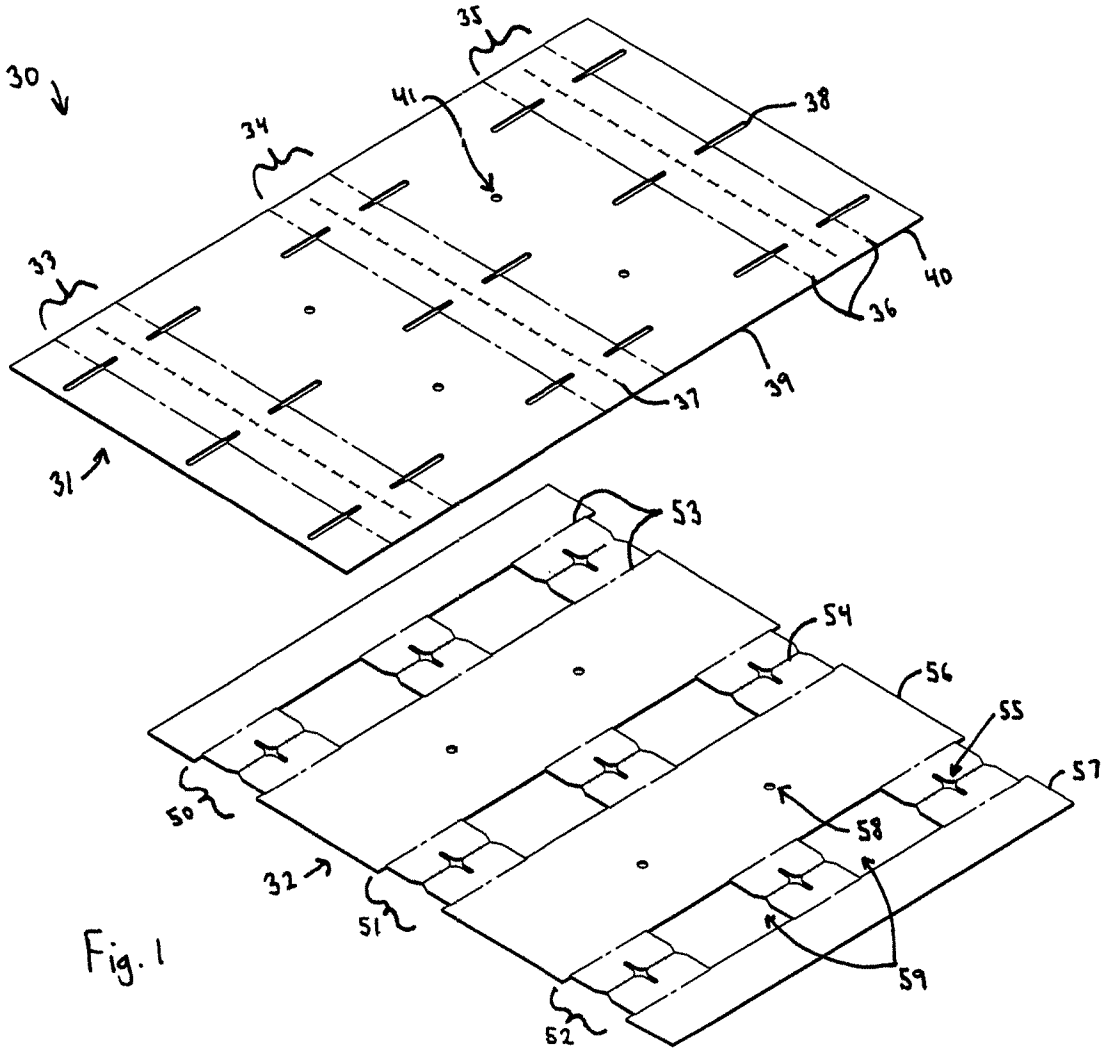
FIG. 1 is an isometric drawing of a corrugated skid in unassembled flat blank state in accordance with the invention.
Figure 3:
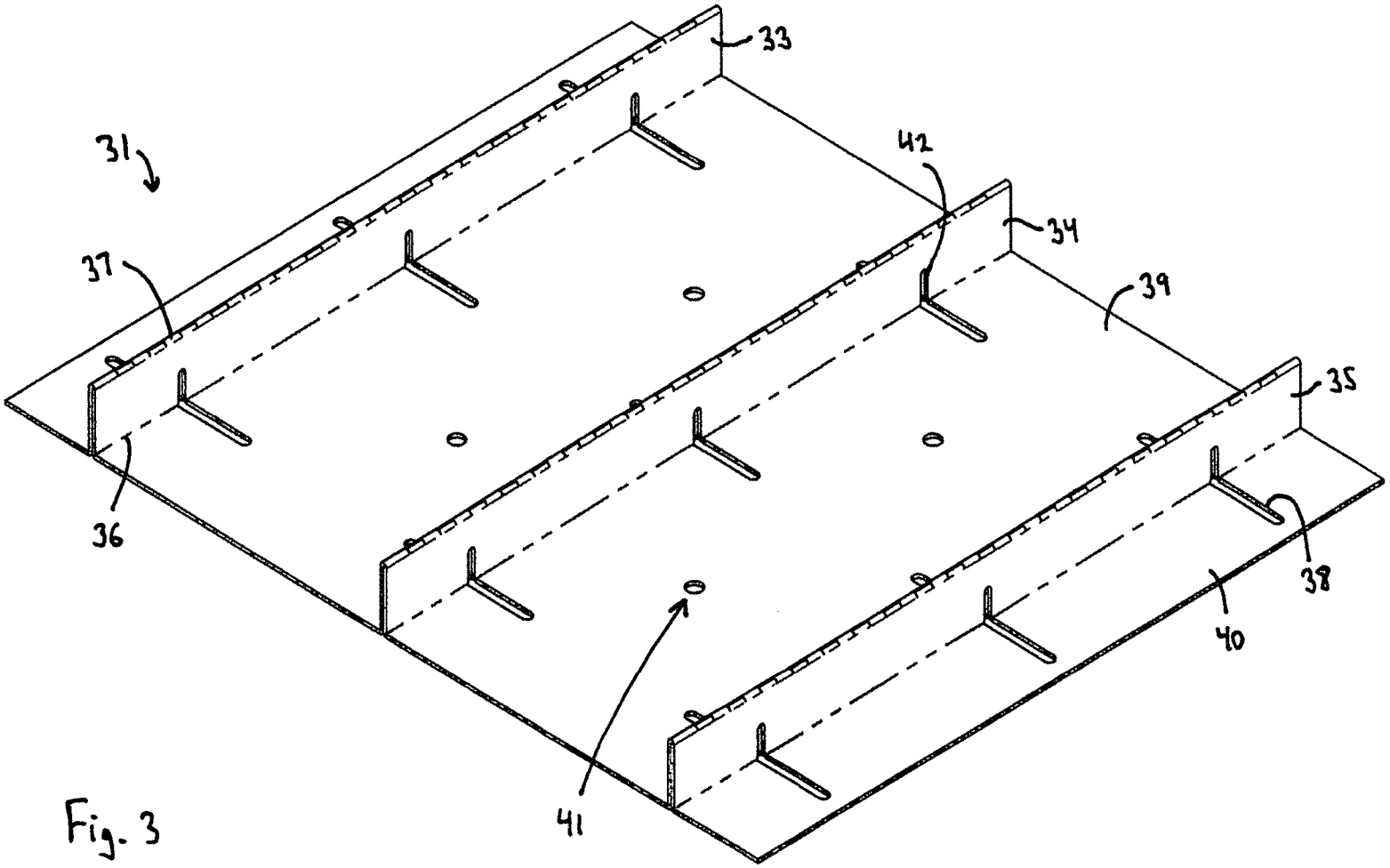
FIG. 3 is an isometric drawing of the bottom blank of the corrugated skid of FIG. 1, with ribs folded from in accordance with the invention.

Turning to the drawings, wherein like reference characters designate identical or corresponding parts, FIG. 1 shows a lower or bottom blank 31 and an upper or top blank 32 of a corrugated skid 30 in unassembled flat blank state. The skid 30 (shown assembled in FIG. 5) is a two way skid with fork entries on only two of the four sides when assembled. It is shown inverted for aiding the assembly process. The lower blank 31 has three rib sections 33, 34, 35 that fold into ribs along base or root fold lines 36 and crest fold lines 37 to form ribs 33, 34, 35 when folded, as shown in FIG. 3. Although shown with three rib sections 33, 34, 35, the skid 30 could utilize more for added load support. Slots 38 in deck sections 39, 40 of the lower blank 31 run perpendicular to and end at the bottom blank rib root fold lines 36, and have narrower extensions 42 that form bottom blank notches, shown in FIG. 3. The bottom blank notches 42 extend across the bottom blank rib root fold lines 36 and terminate short of the bottom blank rib crest fold lines 37. Holes 41 in the deck section 39 may be provided to ease assembly.

The upper blank 32 has three rib sections 50, 51, 52 that are folded to form ribs 50, 51, 52 in the assembled skid 30. The rib portions 50, 51, 52 fold into ribs along base fold lines 53 and crest fold lines 54. Notches 55 in the rib sections 50, 51, 52 form notches in the assembled ribs. Rib sections 50, 51, 52 are folded vertically from upper blank deck sections 56, 57. Holes 58 in the deck section 56 are provided to ease assembly. Cut outs 59 in the rib sections 50, 51, 52 are provided to produce fork passagcs in the assembled skid 30.

Figure 2:
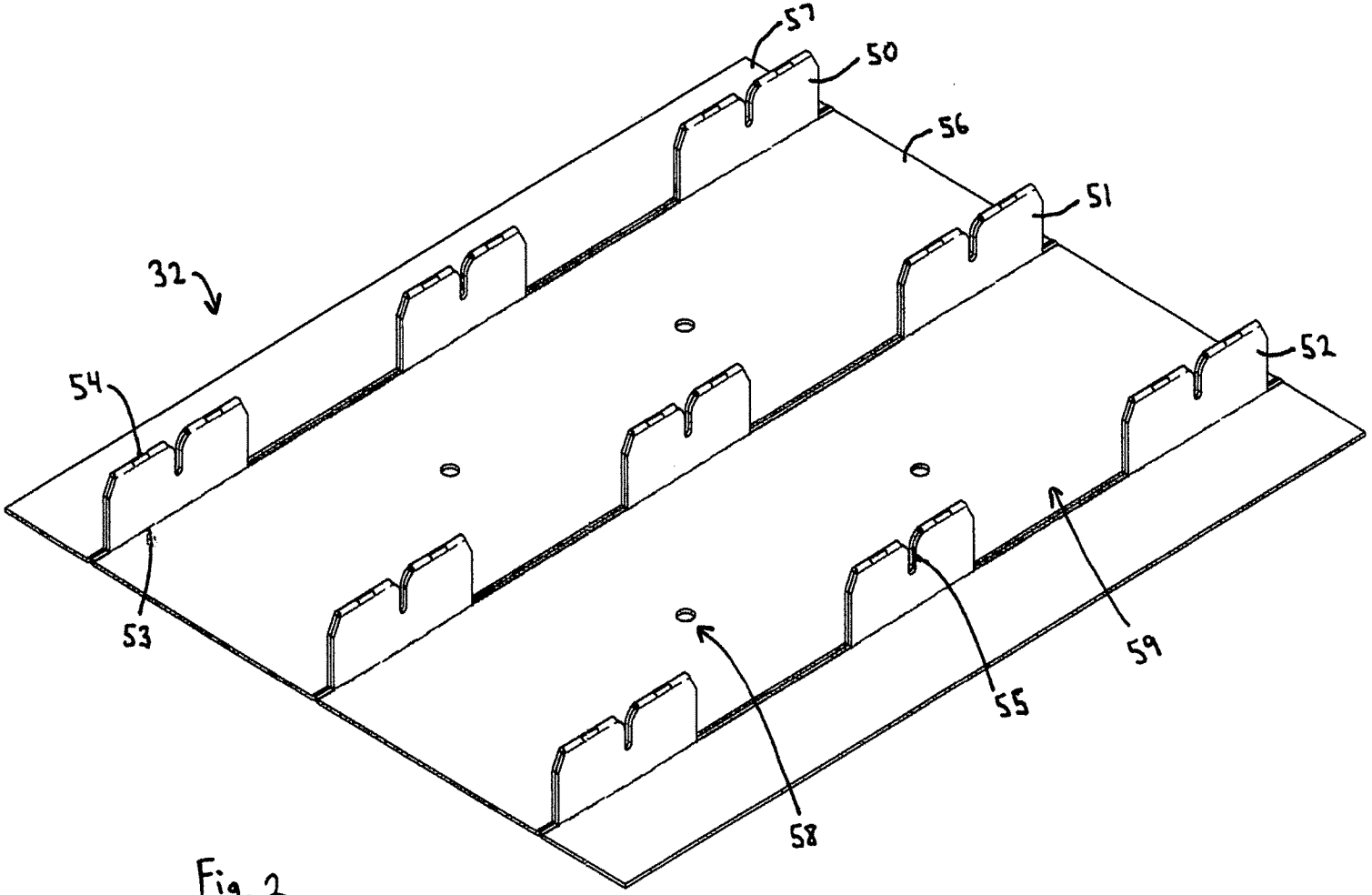
FIG. 2 is an isometric drawing of the top blank of the corrugated skid of FIG. 1, with ribs folded in accordance with the invention.

The top blank with ribs folded of the corrugated skid of FIG. 1 in accordance with the invention is shown in FIG. 2. The top blank 32 has ribs 50, 51, 52 folded from the deck sections 56, 57 on root fold lines 53 and crest fold lines 54 to protrude vertically from deck sections 56, 57. The crest 54 of the ribs 50, 51, 52 can be considered the axis of those ribs. Notches 55, narrower than the slots 38, extend perpendicularly across the crest fold lines 54, terminating short of the root fold lines 53. Holes 58 are provided for holding the top blank 32 during assembly.

The bottom blank of the corrugated skid of FIG. 1 with ribs folded is shown in FIG. 3. The bottom blank 31 has ribs 33, 34, 35 folded to protrude vertically from upper deck portions 39, 40. The ribs 33, 34, 35 fold from upper deck portions 39, 40 along base fold lines 36 with the tops of the ribs folding on crest fold lines 37. Slots 38 in the bottom blank 31 extend to the root fold lines 36, and notches 42 extend as a continuation of the slots 38, ending short of the crest fold lines 37, to make through notches 42 at the root end of the ribs 33, 34, 35. The crest 37 of the ribs 33, 34, 35 can be considered the axis of those ribs. Holes 41 are provided to help hold the bottom blank 31 during assembly.

Figure 4:
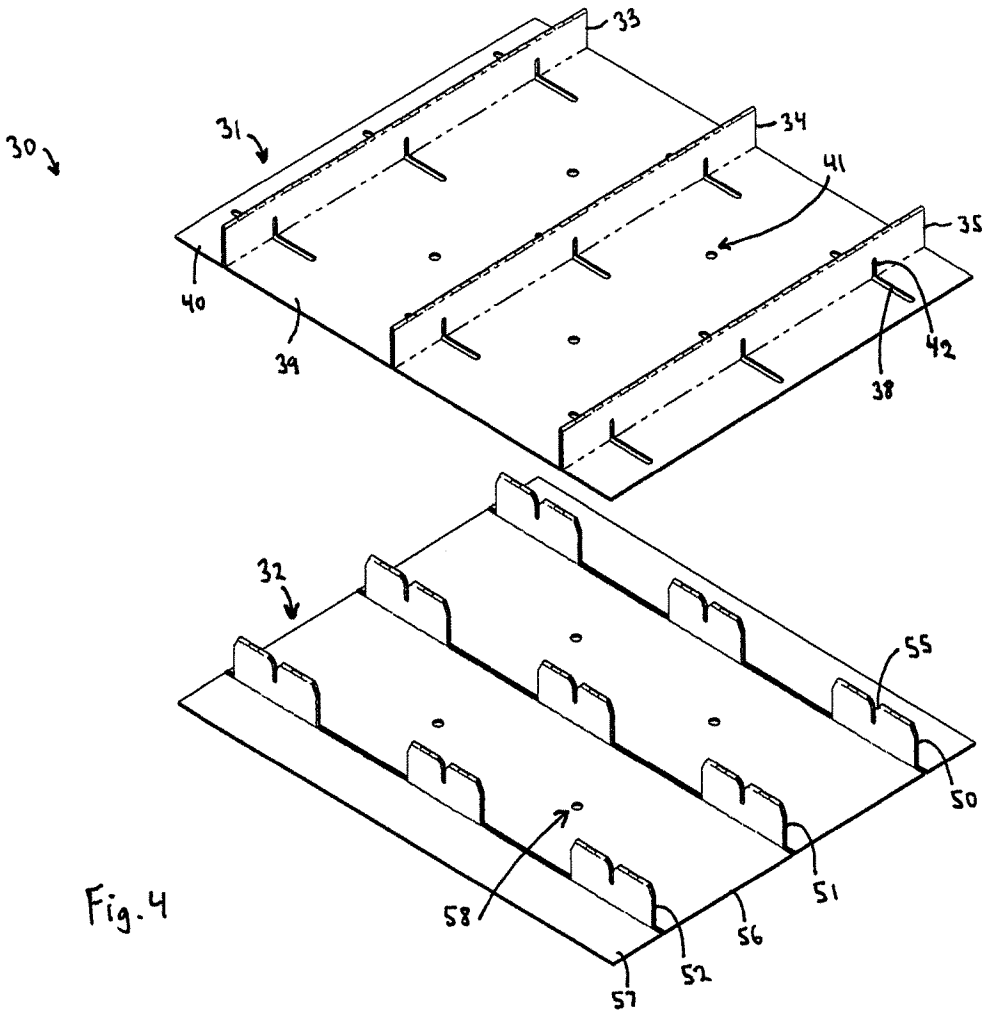
FIG. 4 is an isometric drawing of the corrugated skid of FIG. 1, with the top and bottom blanks aligned for assembly together in accordance with the invention.

The top and bottom blanks of the corrugated skid of FIG. 1 are aligned prior to assembly together, as shown in FIG. 4. The skid 30 is formed by aligning top and bottom blanks 32, 31 with the axes of ribs 33, 34, 35 lying perpendicular with the axes ribs 50, 51, 52, all ribs extending vertically from the deck in the same direction. Blanks 31, 32 will be subsequently assembled vertically together such that ribs 50, 51, 52 penetrate slots 38 and notches 55-at the top of the ribs 50, 51, 52 lock into through slots 42 at the roots of ribs 50,51, 52. The top blank ribs 50, 51, 52 freely penetrate the bottom blank slots 38, and the narrower width notches 42, 55 in the bottom and top ribs are sized to engage said top and bottom ribs, respectively, to hold the bottom and top ribs securely closed against spreading open. Holes 41, 58 can be utilized to hold blanks 31, 32 in position to facilitate vertical assembly together. Adhesive, staples or other fastening methods, such as ultrasonic welding in the case of corrugated plastic blanks, may be applied between upper deck portions 56, 57 and 39, 40 to make the finished skid stronger and stiffer, but it is not required. Fastening methods preferably reduce the bending shear displacement between the upper deck layers across the surface including areas away from the locations of the top blank ribs. The reduction of shear displacement can dramatically increase the top deck bend stiffness and strength.

Figure 5:
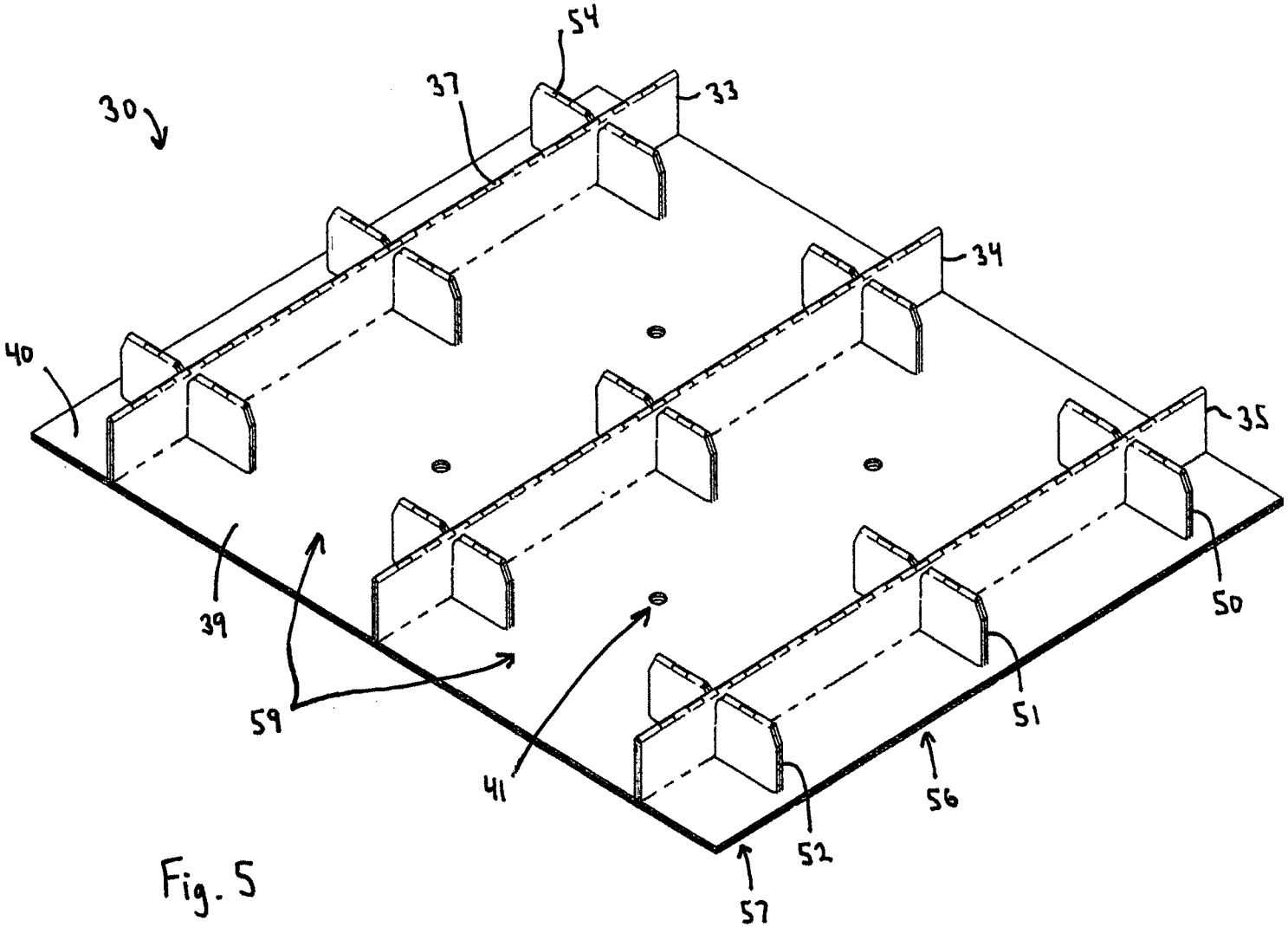
FIG. 5 is an isometric drawing of the assembled corrugated skid of FIG. 1, inverted from its normal load bearing position.

The assembled corrugated skid of FIG. 1 in accordance with the invention is shown in FIG. 5. The skid 30 has top blank 32 compressed together with bottom blank 31 such that deck portions 39, 40 are in face-to-face contact with deck portions 56, 57, forming a double-thickness deck. Ribs 50, 51, 52 lock and support ribs 33, 34, 35, holding them in closed position, and vice versa. Holes 41 align with holes 58. Fork passages 59 allow for lifting of the skid using forked equipment. After assembly, the skid 30 is flipped upside down for use. Inverted assembly can make the assembly easier; however othcr assembly methods could be utilized instead.

Figure 6:
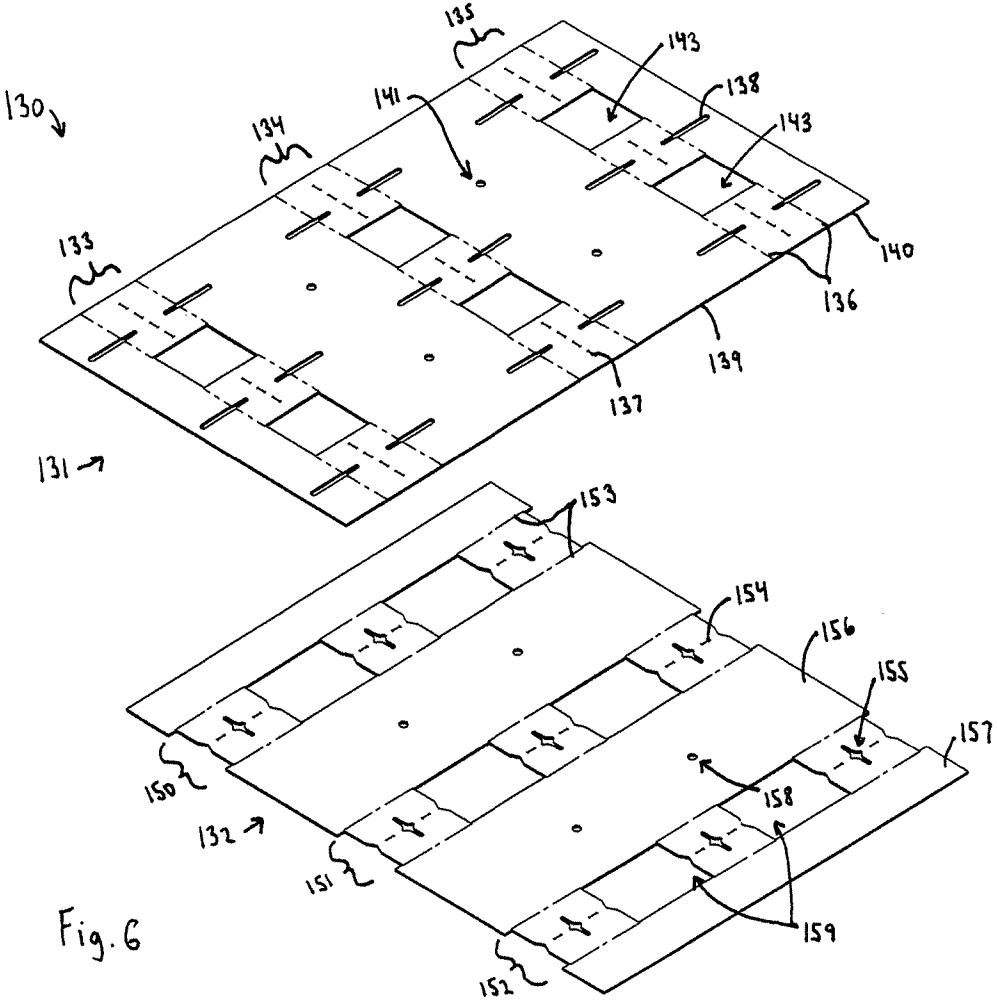
FIG. 6 is an isometric drawing of an alternate configuration corrugated skid in unassembled flat blank state in accordance with the invention.
Figure 7:
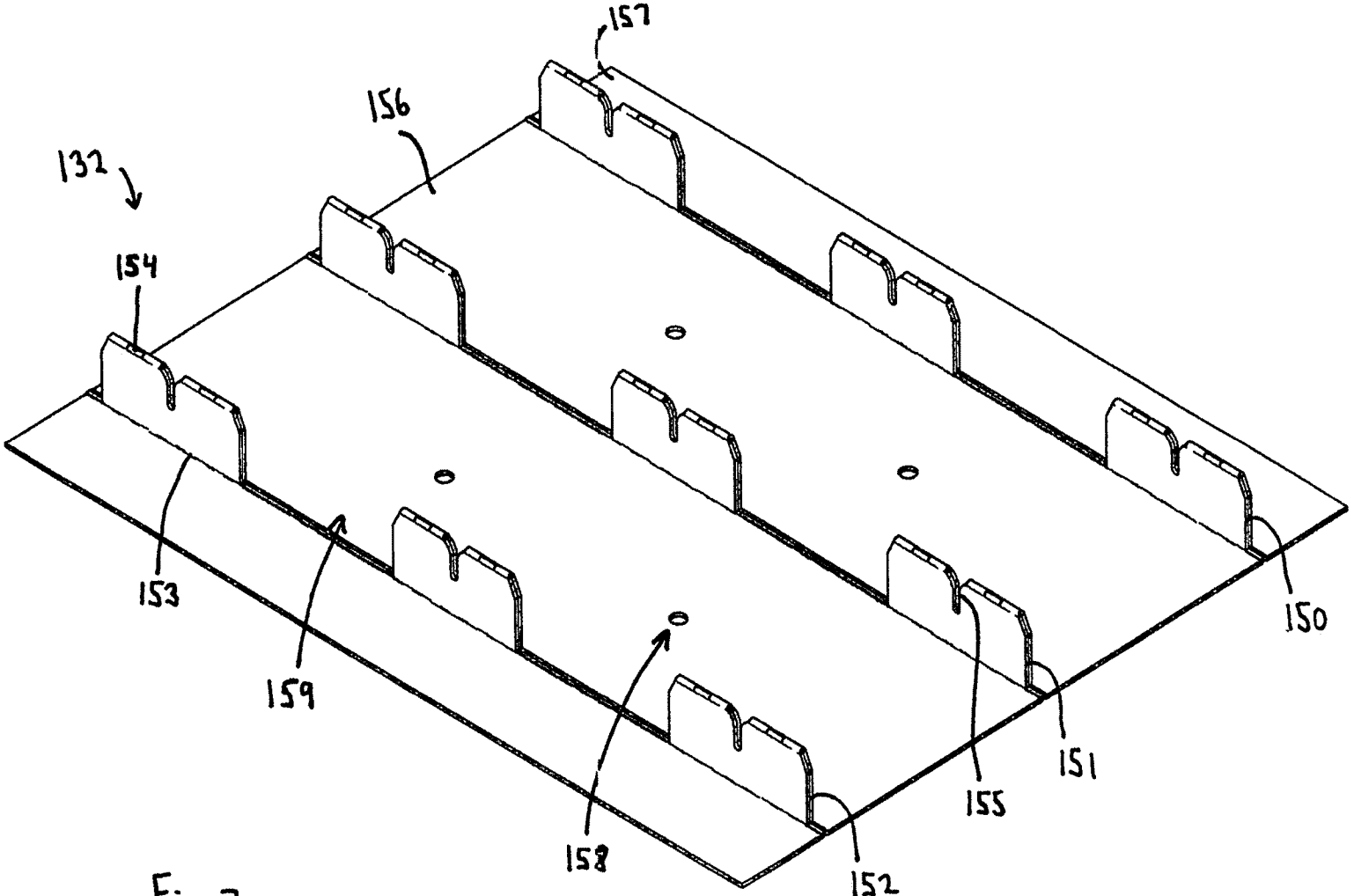
FIG. 7 is an isometric drawing of the top blank of the corrugated skid of FIG. 6, with ribs folded in accordance with the invention.

An alternate configuration corrugated skid in unassembled flat blank state in accordance with the invention is shown in FIG. 6. The skid shown is a four way skid with fork entries on all four sides when assembled. The skid 130 is comprised of a lower or bottom blank 131 and an upper or top blank 132, shown flipped for aiding the assembly process. The lower blank 131 has three rib sections 133, 134, 135 that form ribs in the assembled skid 130. The rib portions 133, 134, 135 fold into ribs along base or root fold lines 136 and crest fold lines 137. Although shown with three rib sections 133, 134, 135, the skid 130 could utilize more for added load support. Slots 138 in the lower blank 131 extend between the adjacent rib root fold line of rib sections 133, 134, 135 and upper deck sections 139, 140; notches 142 extend from the rib root fold lines 136 and into the rib sections 133, 135, 135, as extensions of the slots 138, terminating short of the crest fold lines 137. Holes 141 in the upper deck 139 are provided to ease assembly. The upper blank 132 has three rib sections 150, 151, 152 that form ribs in the assembled skid 130. The rib portions 150, 151, 152 fold into ribs along base fold lines 153 and crest fold lines 154. Notches 155 in the rib sections 150, 151, 152 form notches in the assembled ribs. Rib sections 150, 151, 152 are folded vertically from upper deck sections 156, 157 to produce ribs 150, 151, 152 as shown in FIG. 7. Holes 158 in the upper deck 156 are provided to ease assembly. Cut outs 159 in the rib sections 150, 151, 152 are provided to produce fork passages in the assembled skid 130. Cut outs 143 in the rib sections 133, 134, 135 are provided to produce fork passages in the assembled skid 130.

The top blank with ribs folded of the corrugated skid of FIG. 6 in accordance with the invention is shown in FIG. 7. The top blank 132 has ribs 150, 151, 152 folded to protrude vertically from upper deck sections 156, 157. The ribs 150, 151, 152 are folded from the top blank rib sections 156, 157 along base fold lines 153 with the tops of the ribs folding on the crest fold lines 154. Holes 158 are provided for holding the top blank 132 during assembly.

Figure 8:
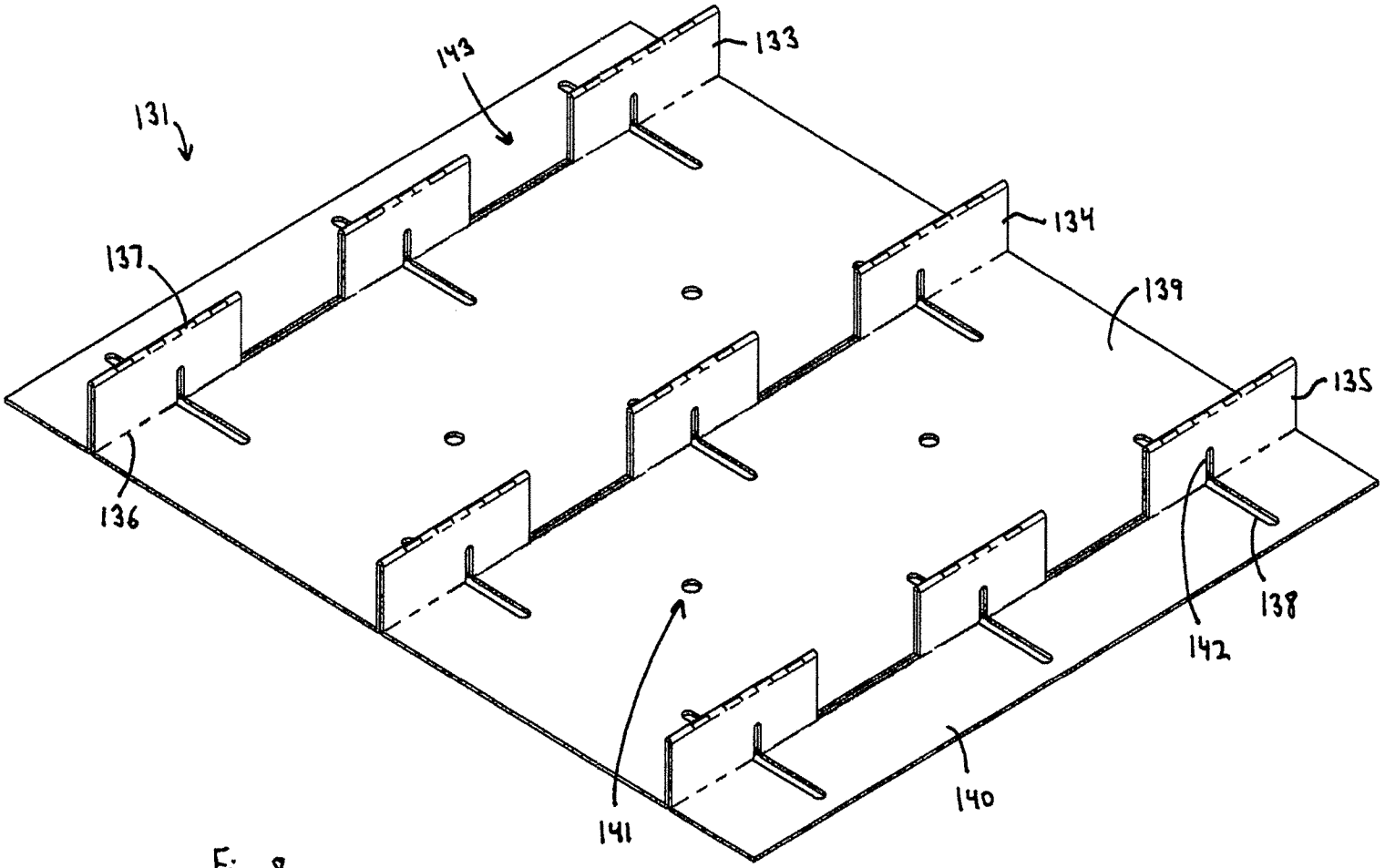
FIG. 8 is an isometric drawing of the bottom blank of the corrugated skid of FIG. 6, with ribs folded in accordance with the invention.

The bottom blank 131 corrugated the skid of FIG. 6 with ribs folded is shown in FIG. 8. The bottom blank 131 has ribs 133, 134, 135 folded to protrude vertically from bottom blank portions 139, 140. The ribs 133, 134, 135 fold from upper deck portions 139, 140 along base fold lines 136 with the tops of the ribs folding on crest fold lines 137. Slots 138 in the bottom blank 131 have narrower portions extending across the root fold lines 136 into the rib sections 133, 134, 135 and termination short of the crest fold lines 137, forming notches 142 in the ribs 133, 134, 135 when the bottom blank 131 is folded to form the ribs 133, 135, 135. Holes 141 are provided to help hold the bottom blank 131 during assembly.

Figure 9:
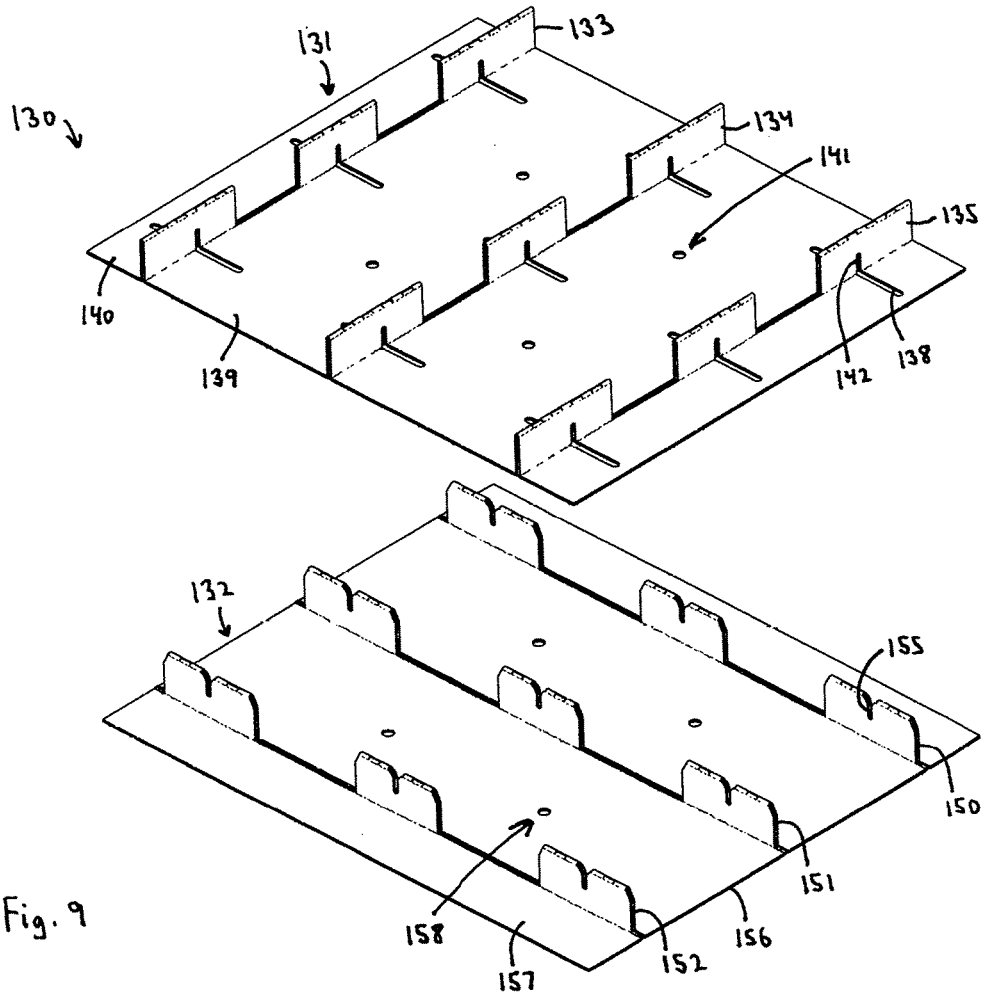
FIG. 9 is an isometric drawing of the corrugated skid of FIG. 6, with the top and bottom blanks aligned prior to assembly together in accordance with the invention.

The top and bottom blanks, aligned prior to assembly together, are shown in FIG. 9. The skid 130 is formed by aligning top and bottom blanks 132, 131 with ribs 133, 134, 135 to be perpendicular with ribs 150, 151, 152, all extending vertically in the same direction. Blanks 131, 132 will be subsequently assembled axially together such that ribs 150, 151, 152 penetrate slots 138 and notches 155 locking into notches 142. Holes 142, 158 can be utilized to hold blanks 131, 132 into position and form to facilitate axial assembly together. Adhesive may be applied between upper deck portions 156, 157 and 139, 140 to make the fulished skid stronger, depending on the requirements of the shipper, but it is not required in most cases.

Figure 10:
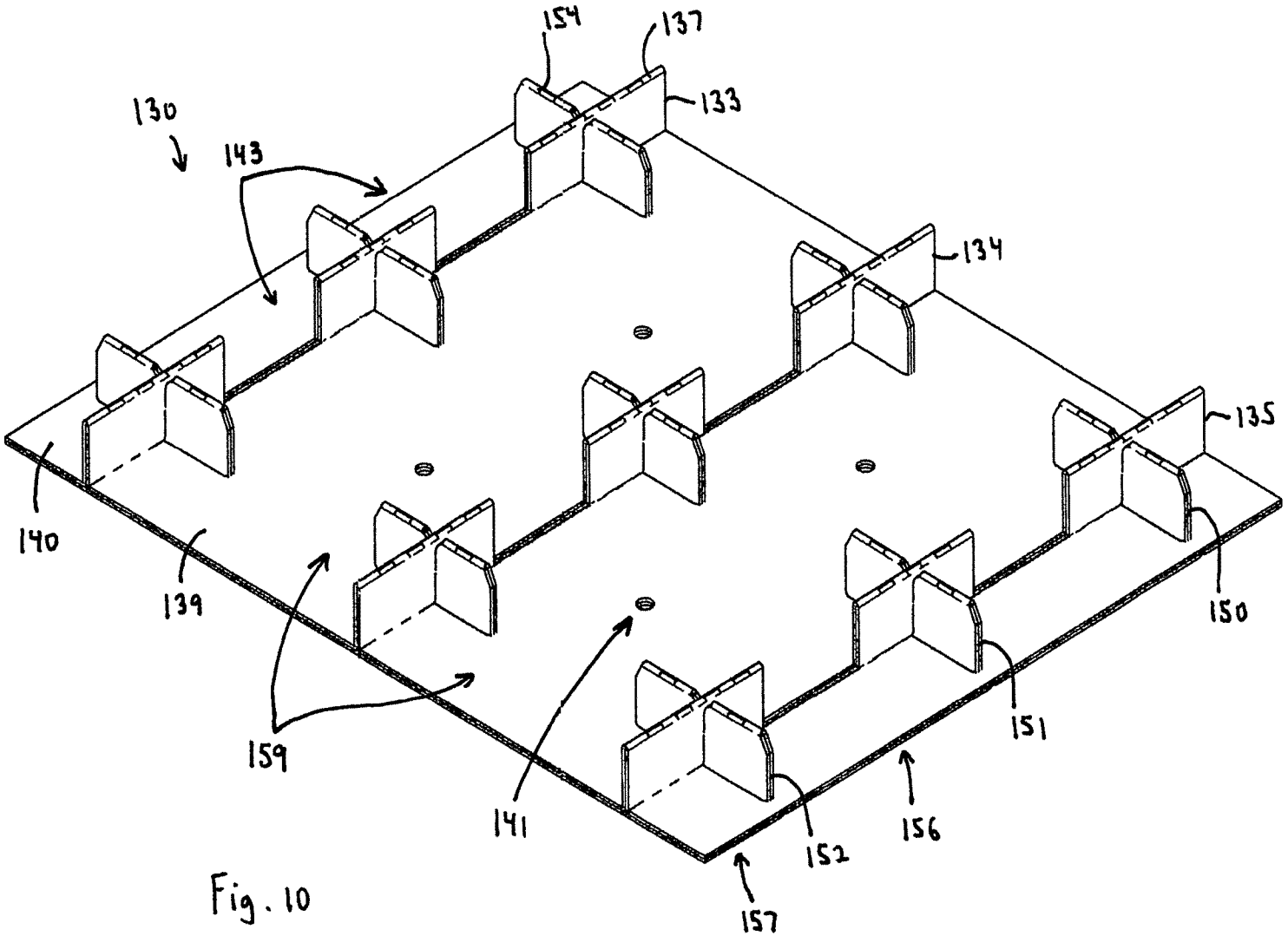
FIG. 10 is an isometric drawing of the corrugated skid of FIG. 6, with the top and bottom blanks assembled in accordance with the invention.

The assembled corrugated skid of FIG. 6 in accordance with the invention is shown in FIG. 10. The skid 130 has top blank 132 compressed together with bottom blank 131 such that upper deck portions 139, 140 are adjacent to upper deck portions 156, 157. Ribs 150, 151, 152 lock and support ribs 133, 134, 135 and vice versa. Holes 141 align with holes 158. Fork passages 143, 159 allow for lifting of the skid using forked equipment. After assembly, the skid 130 is flipped upside down for use. Inverted assembly can make the assembly easier, however other assembly methods could be utilized instead. Typical construction material is corrugated BC doublewall corrugated paperboard, although use of single wall is also possible for some lighter applications.

Figure 11A:
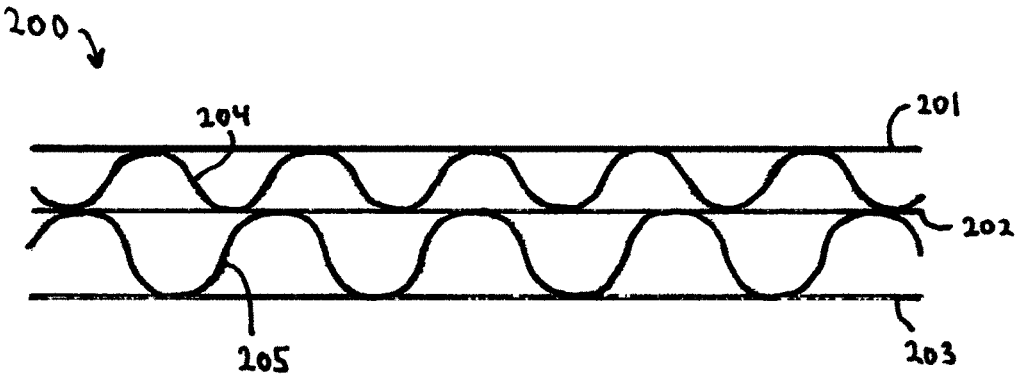
FIGS. 11A and 11B are cross-sectional drawings of corrugated paperboard and corrugated plastic for use in construction of corrugated skids in accordance with the invention.
Figure 11B:
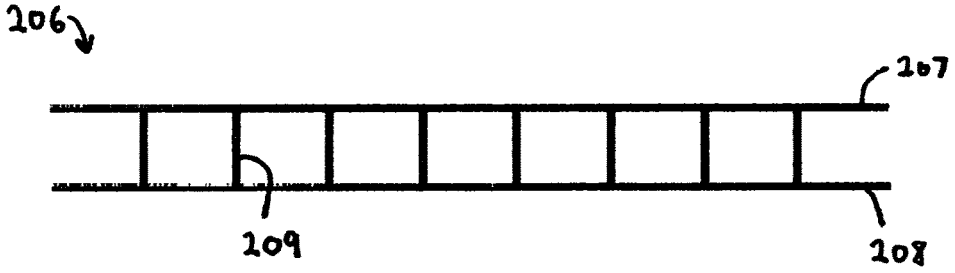

Cross-sectional drawings of corrugated paperboard and corrugated plastic for use construction of a corrugated skid in accordance with the invention are shown in FIG. 11A and 11B. Corrugated paperboard 200 can take many different configurations including single wall, double wall as shown and triple wall, depending on the load capability required. The corrugated paperboard 200 is comprised of liners 201, 202, 203 and mediums 204 and 205. The basis weights of each of the liners 201, 201, 203 and mediums 204, 205 may also be adjusted depending on the load and shipping attributes.

In some instances, it may be desirable to construct the skids of the invention from corrugated plastic. Corrugated plastic can be produced with wavy mediums similar to corrugated paperboard or alternatively with a straight vertical medium. The corrugated plastic 206 comprises outer liners 207 and 208 that are connected by medium 209, typically all formed by sheet extrusion. The thickness of the liners and medium 207, 208, 209 as well as total overall thickness may be selected depending on the load and shipping attributes. It is also possible to use reinforced plastics such as with carbon black, other particles or fiber reinforcement.

Figure 12:
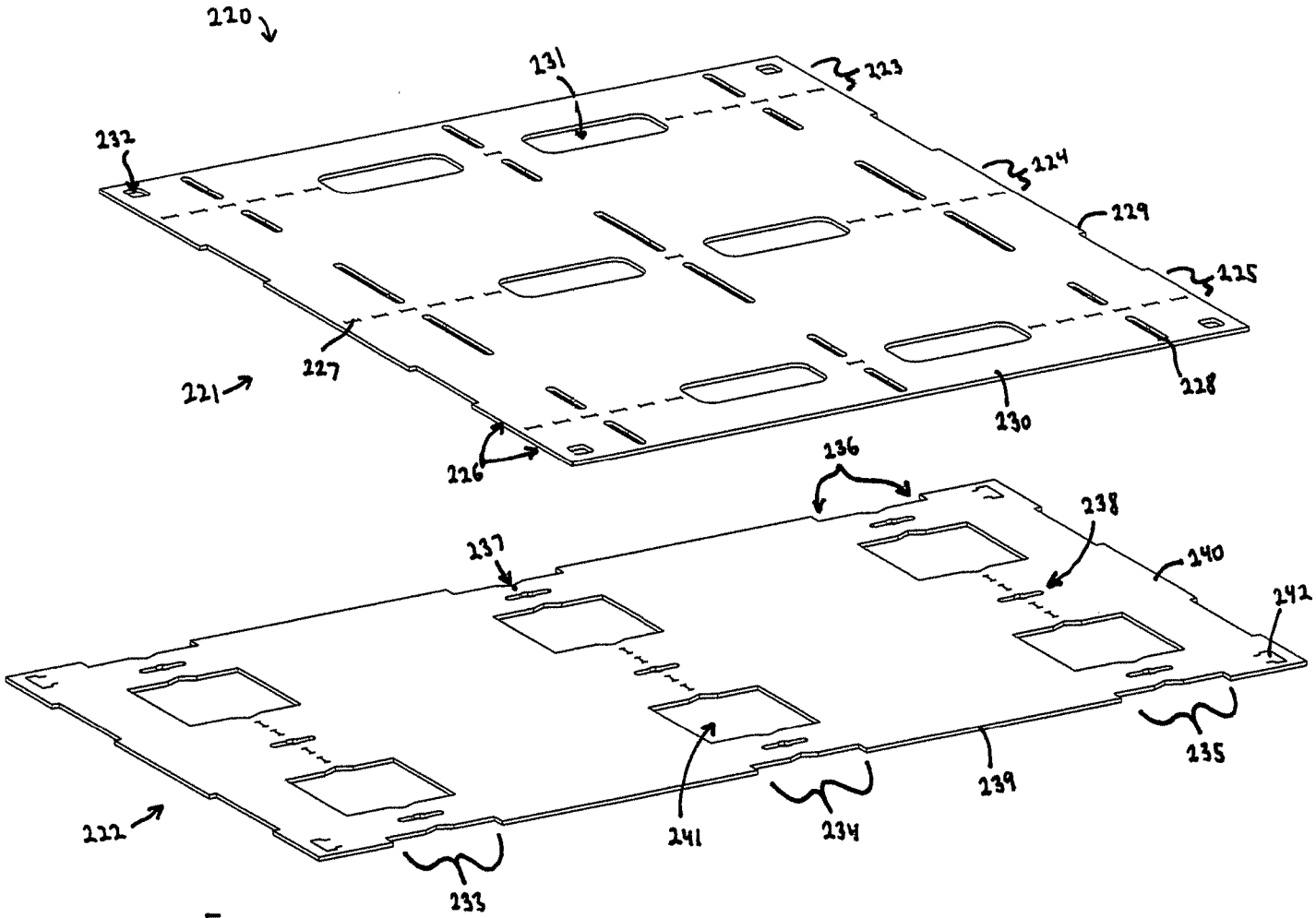
FIG. 12 is an isometric drawing of an alternate configuration of a corrugated skid in unassembled flat blank state in accordance with the invention.

An isometric drawing of an alternate configuration of a corrugated skid in unassembled flat blank state in accordance with the invention is shown in FIG. 12. This configuration provides four way forklift access and two way pallet jack access. The corrugated skid 220 is comprised of an lower blank 221 and an upper blank 222. The lower blank 221 has three rib sections 223, 224, 225 as well as deck portions 229 and 230. The rib sections 223, 224, 225 fold vertically along base fold lines 226 and crest fold line 227. Slots 228 are provided for allowing assembly of the completed skid 220. Cut outs 231 become forklift notches in the assembled skid 220. Corner lock receptacles 232 allow for locking of the top and bottom blanks 222 and 221 together in the completed skid 220. The top blank 222 comprises three rib sections 233, 234, 235 that fold vertically along base fold lines 236 and crest fold lines 237. The top blank further comprises deck portions 239 and 240 and corner locking tabs 242 allow locking of the top and bottom blanks 222 and 221 together in the completed skid 220. Rib portions 233, 234, 235 also include notches 238 that lock together with rib portions 223, 234, 235 when assembly is completed. Cut outs 241 become fork passages in the assembled skid.

Figure 13:
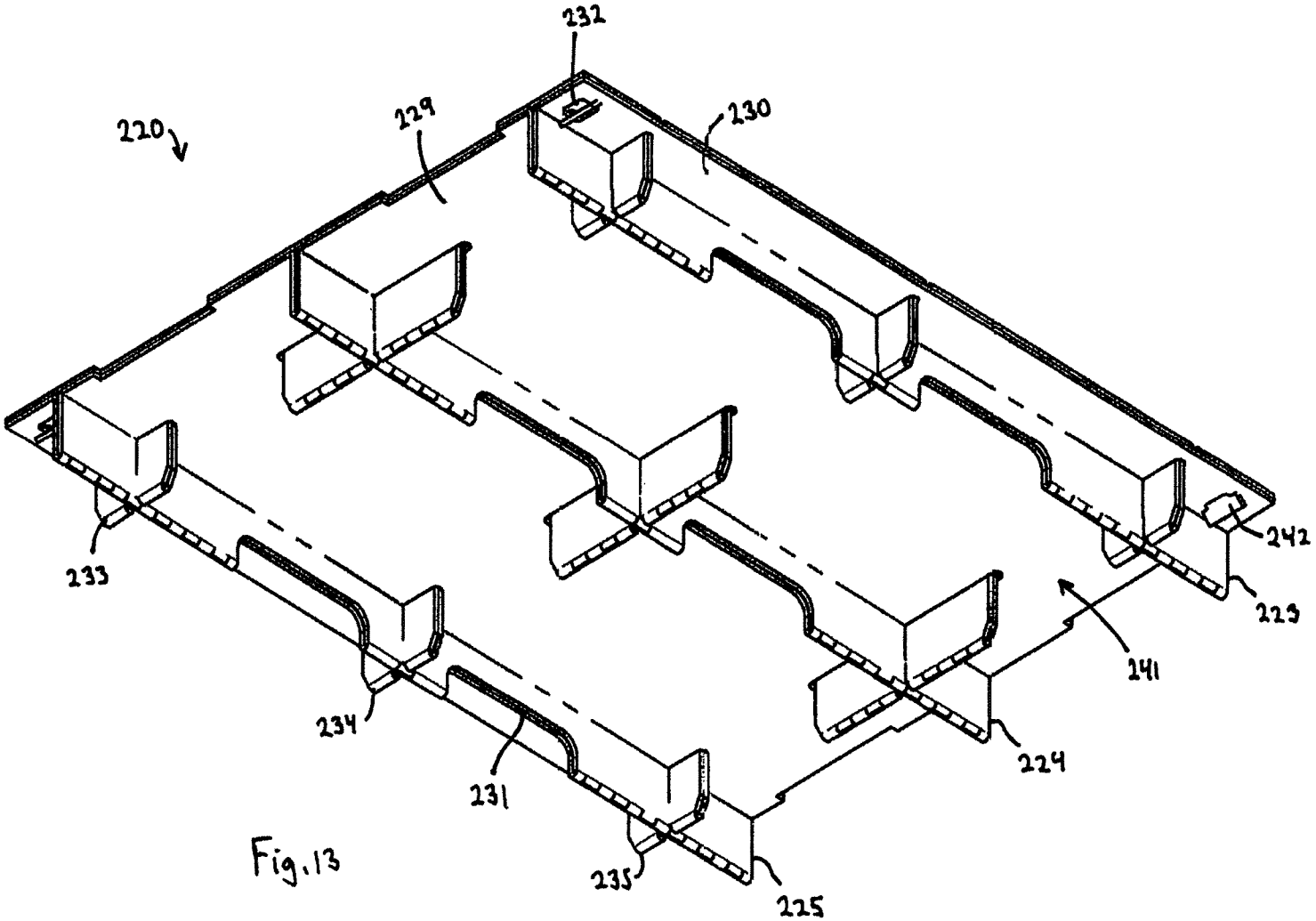
FIG. 13 is an isometric drawing of the assembled corrugated skid of FIG. 12 in accordance with the invention.

An isometric drawing of the assembled corrugated skid of FIG. 12 in accordance with the invention is shown in FIG. 13. The three ribs 223, 224, 225 of the bottom blank 221 intersect perpendicularly with the three ribs 233, 234, 235 of the top blank 222. Deck portions 229 and 230 provide a support for a load. Corner locking tabs 242 penetrate corner locking receptacles to lock together the top and bottom blanks 222, 221. Forklift notches 231 and fork passages allow lifting of the skid with either a forklift or a pallet jack.

Figure 14:
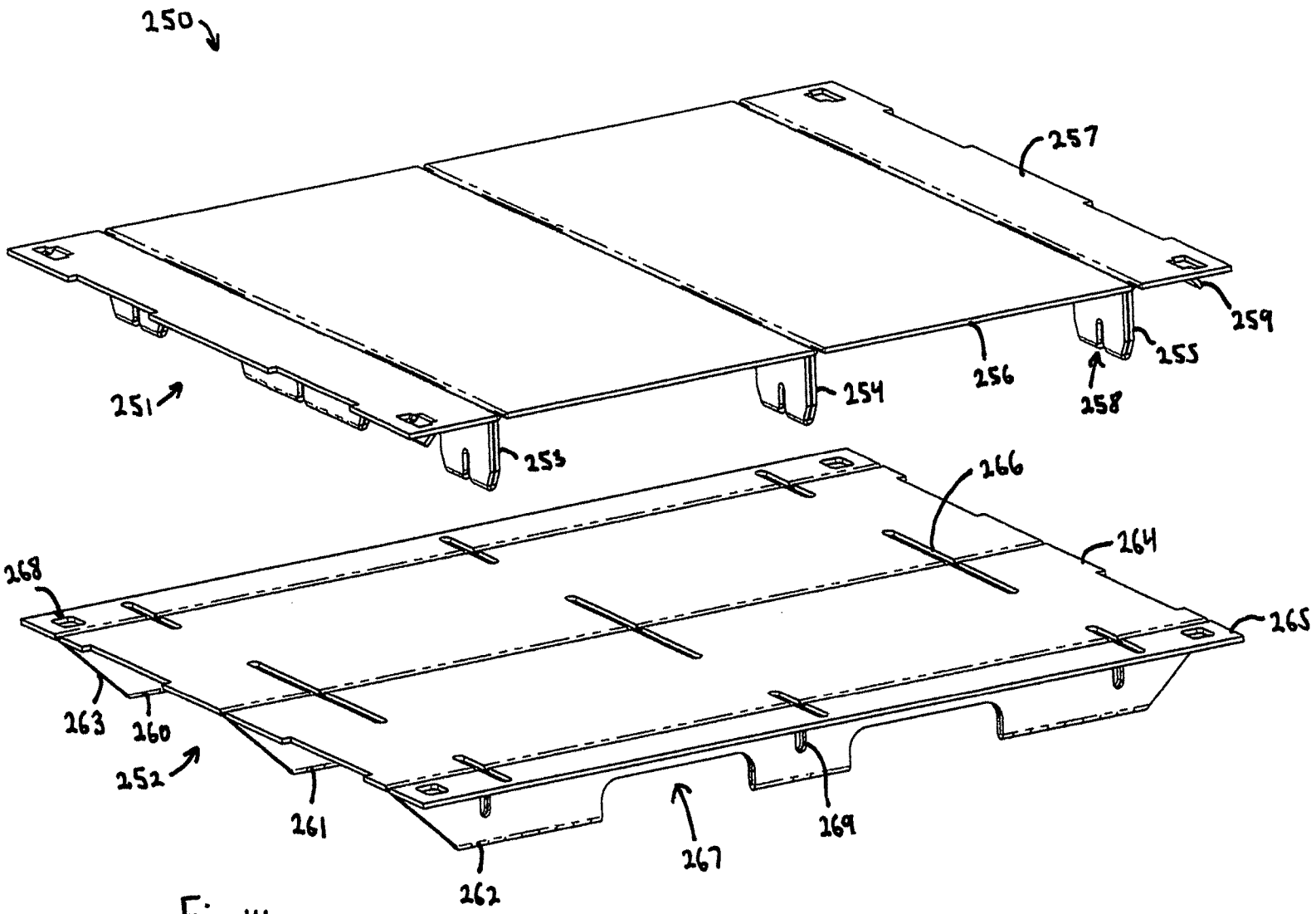
FIG. 14 is an isometric drawing of an alternate configuration corrugated skid with the top and bottom blanks aligned prior to assembly together in accordance with the invention.

An isometric drawing of an alternate configuration corrugated skid with the top and bottom blanks aligned prior to assembly together in accordance with the invention is shown in FIG. 14. This configuration is designed to work on air cargo platforms known as cookie sheets. The skid 250 is comprised of an upper blank 251 and lower blank 252 that are assembled vertically together. The upper blank 251 is folded to produce downward extending ribs 253, 254, 255 having vertical bottom opening notches 258. Adjacent the ribs 253, 254, 255 are deck panels 256 and 257 for supporting a shipping load, not shown. Corner locking tabs 259 are provided for locking the top blank 251 and bottom blank 252 together upon assembly. The bottom blank 252 also is folded to produce downward extending ribs 260, 261, 261 but having vertical top opening notches 269. To allow maximum use of shipping space in air cargo with use of cookie sheets, ribs 260, 261, 262 have angled edges 263. Adjacent to ribs 260, 261, 261 are deck panels 264 and 265 for providing a shipping load support area. Slots 266 in the deck panels 264, 265 allow for penetration of ribs 253, 254, 255 during skid assembly and notches 269 receive notches 258. Corner locking receptacles 268 allow receipt of corner locking tabs 259 for locking together the upper and lower blanks 251, 252.

Figure 15:
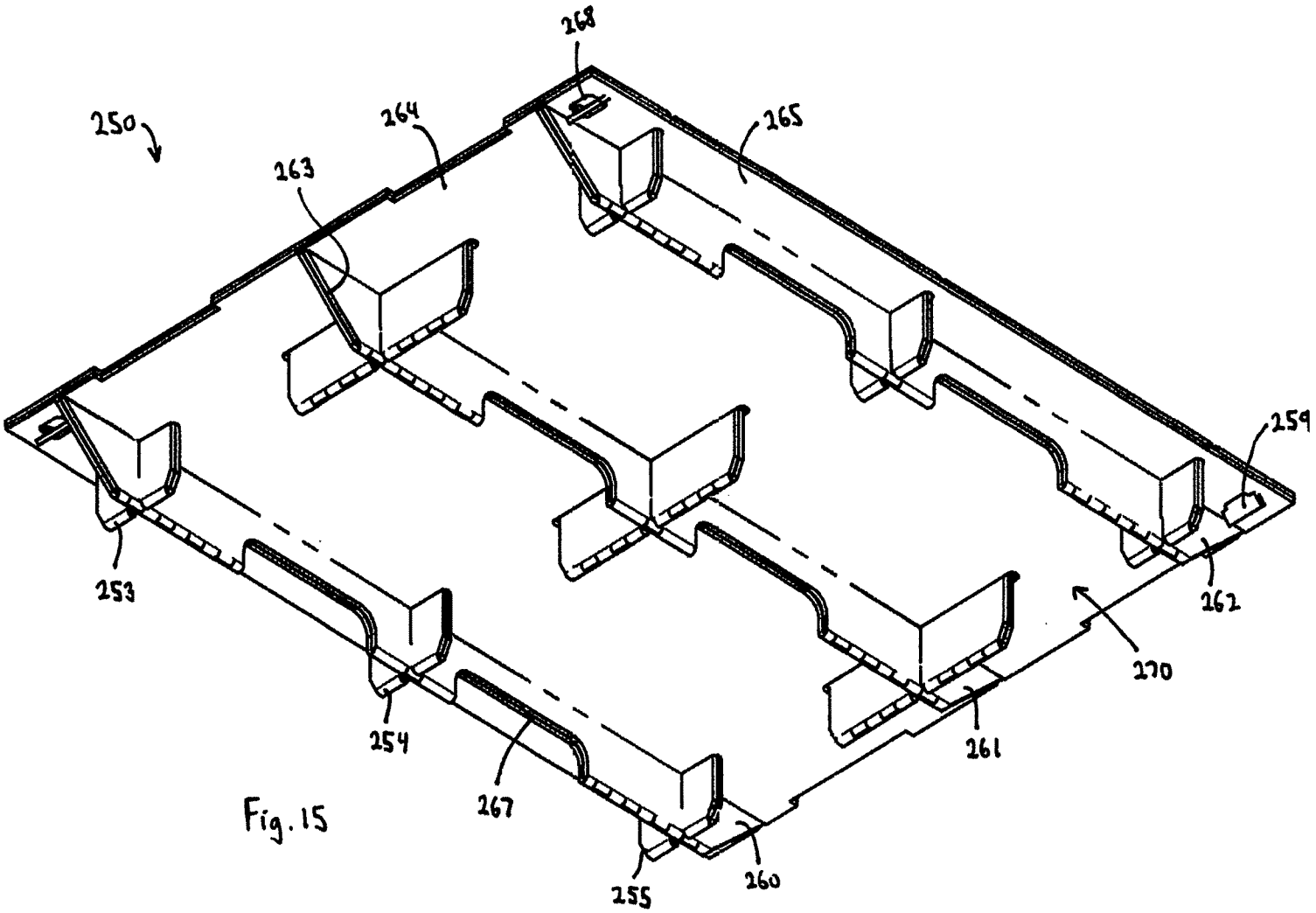
FIG. 15 is an isometric drawing of the assembled corrugated skid of FIG. 14 in accordance with the invention.

An isometric drawing of the assembled corrugated skid of FIG. 14 in accordance with the invention is shown in FIG. 15. The skid 250 comprises ribs 253, 254, 255 of the top blank 251 vertically nested together with ribs 260, 261, 262 of the bottom blank 252. Deck portions 264 and 265 provide for load support area for shipping product. Corner locking tab 259 penetrate corner locking receptacle 268 to lock together top and bottom blanks 151, 252. Forklift notches 267 allow for lifting if the skid by forklifts and fork passages 270 allow for lifting of the skid by forklifts or pallet jacks.

Figure 16:
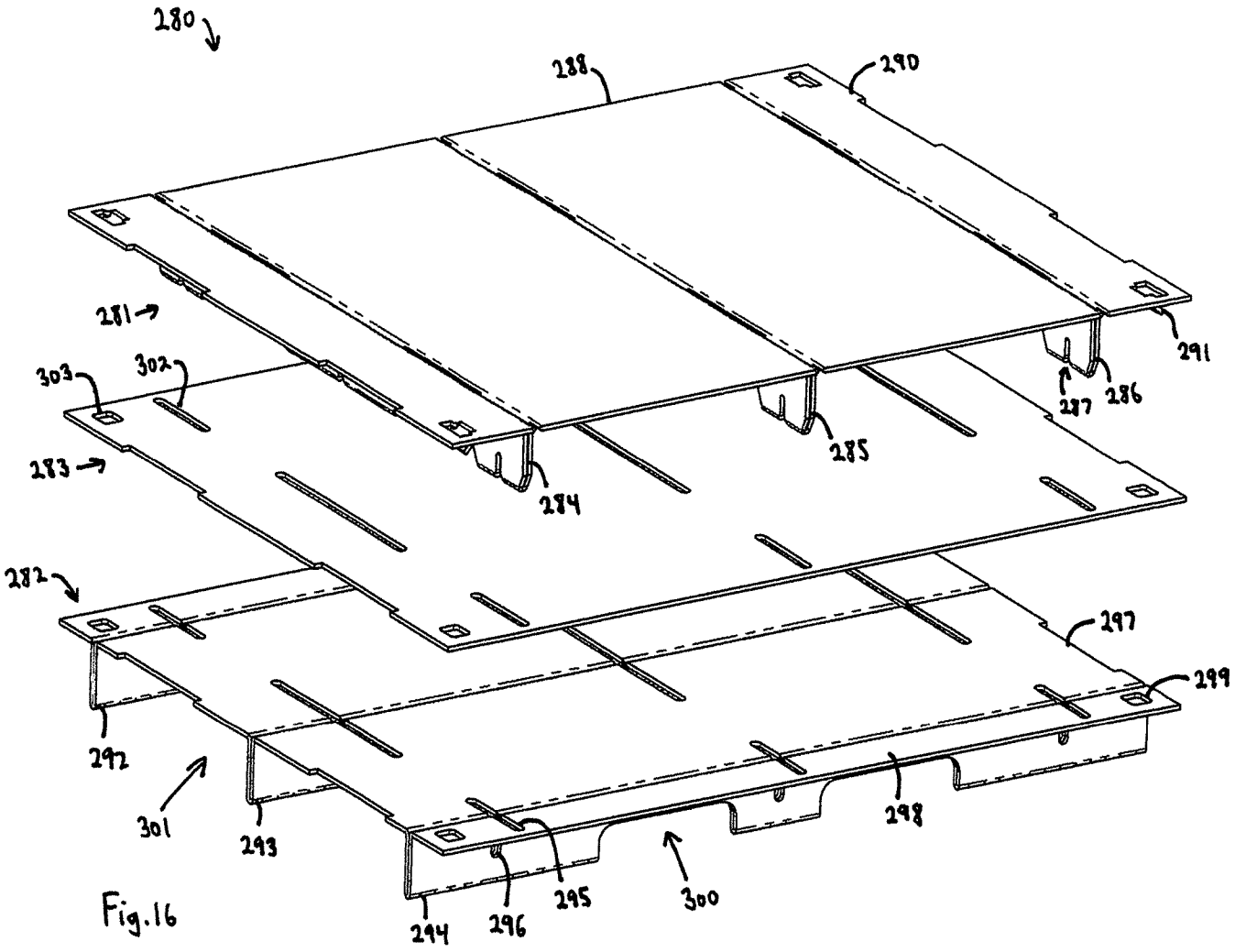
FIG. 16 is an isometric drawing of an alternate configuration corrugated skid with the top, middle and bottom blanks aligned prior to assembly together in accordance with the invention.

An isometric drawing of an alternate configuration corrugated skid with the top, middle and bottom blanks aligned prior to assembly together in accordance with the invention is shown in FIG. 16. Sometimes it is desirable to provide increased deck support stiffness and strength. Such occasions can include the shipping of small sized boxes and this configuration provides that added deck support. The skid 280 is comprised of an upper blank 281, lower blank 282 and middle blank 283. The upper blank 281 is folded to produce downward extending ribs 284, 285, 286 and top deck panels 288, 290. The ribs 284, 285, 286 have downward opening notches 287. Corner locking tabs 291 are provided for locking the blanks 281, 282, 283 together in the skid 280 when assembly is completed. The bottom blank 282 is folded to produce downward extending ribs 292, 293, 294 and deck portions 297, 298 that provide a load support area. Slots 295 in the deck portions 297, 298 and slots 296 in the ribs 292, 293, 294 allow for penetration and locking with ribs 284, 285, 286 and notches 287. Corner lock receptacles allow penetration and locking with corner lock tabs 291 when assembled. The middle blank 283 is a flat sheet that increases the bending moment of inertia and strength and stiffness of the assembled deck portions 288, 290, 297, 298. The middle blank comprises slots 302 for penetration of ribs 284, 285, 286 and corner lock receptacles 303.

Figure 17:
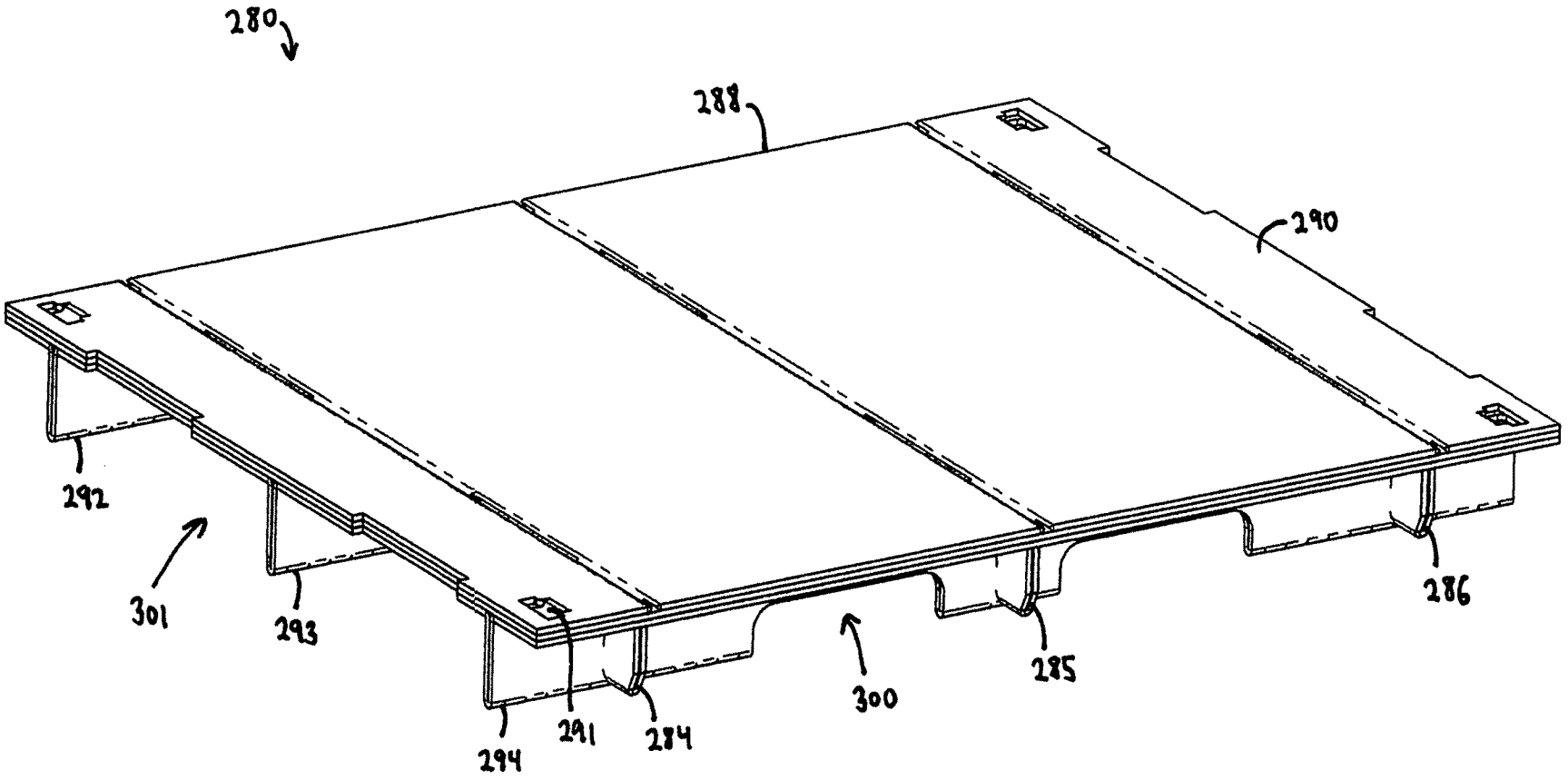
FIG. 17 is an isometric drawing of the assembled corrugated skid of FIG. 16 in accordance with the invention.

An isometric drawing of the assembled corrugated skid of FIG. 16 in accordance with the invention is shown in FIG. 17. The skid 280 provides additional layer of decking for improved load support from the deck portions 288, 290. The skid 280 comprises top blank ribs 284, 285, 286 nesting perpendicularly with bottom blank ribs 292, 293, 294.

forklift notches 300 allow lifting by forklifts and fork passages 301 allow lifting by forklifts or pallet jacks. Additional strength and stiffness may be further developed in the deck portions 288, 290 by fasting the three blanks 281, 282, 283 together either over the entire surface, along edges or inside the outer ribs such that the blank layers cannot slide relative to each other in shear from deck bending.

Figure 18:
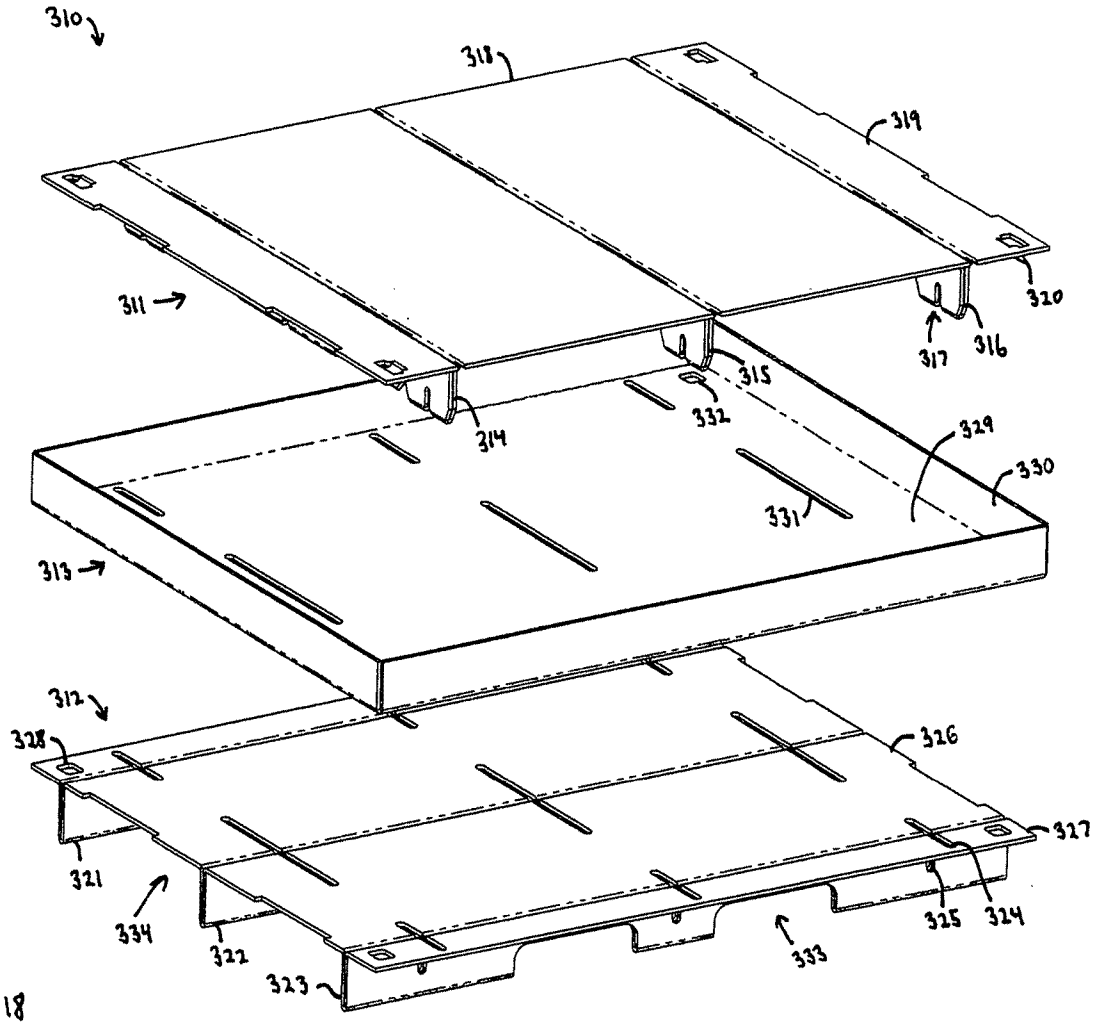
FIG. 18 is an isometric drawing of an alternate configuration corrugated skid with the top, middle and bottom blanks aligned prior to assembly together in accordance with the invention.

An isometric drawing of an alternate configuration corrugated skid with the top, middle and bottom blanks aligned prior to assembly together in accordance with the invention is shown in FIG. 18. Unitizing loads on shipping platforms can be of critical importance. One way to help do that is with a bottom tray. In this configuration of skid, the tray is integrated with the skid for both holding the load together and increasing top deck stiffness. The skid 310 is comprised of a top blank 311, bottom blank 312 and intermediate tray 313. As shown the tray 313 is assembled between the top and bottom blanks 311, 312, however it could alternatively be located as the top or bottom layer but without all of the structural integrity benefits. In those case, staples or other fastening means might be necessary. The top blank 311 comprises downward extending double thickness ribs 314, 315, 316 folded adjacent deck panels 318, 319. The ribs 314, 315, 316 have bottom opening notches 317. Corner locking tabs 320 are provided for locking the blanks 311, 312, 313 together upon assembly. The bottom blank 312 comprises downward extending double thickness ribs 321, 322, 323 folded adjacent to deck panels 326, 327. Slots 324 and notches 325 allow for penetration of ribs 314, 315, 316 and locking with notches 317. Corner locking receptacles 328 are provided for receiving corner locking tabs 320. The intermediate tray 313 comprises a bottom 329 and sidewalls 330. Slots 331 in the bottom 329 allow penetration of ribs 314, 315, 316 while corner locking receptacles allow for locking with corner locking tabs 320.

Figure 19:
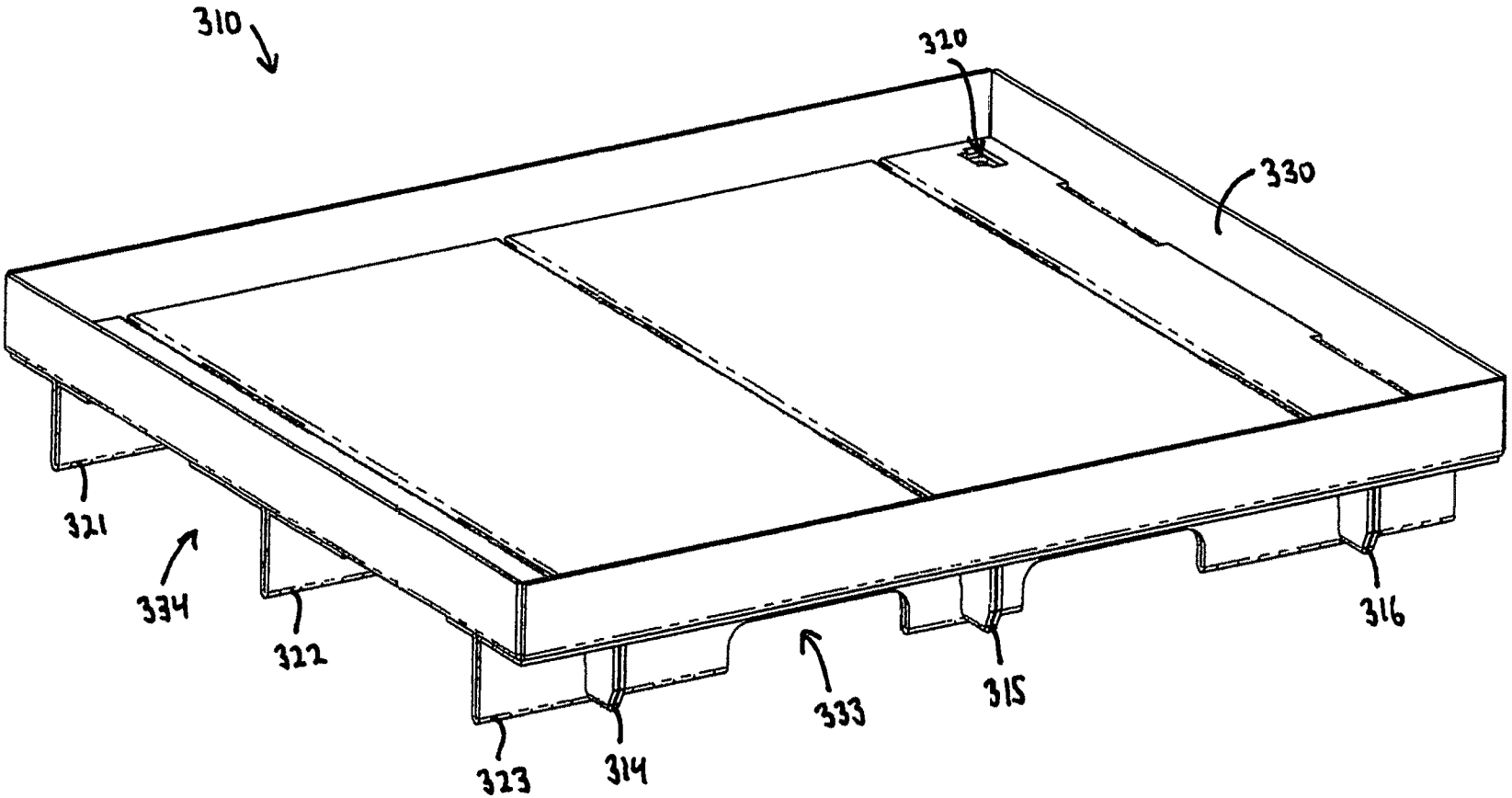
FIG. 19 is an isometric drawing of the assembled corrugated skid of FIG. 18 in accordance with the invention.

An isometric drawing of the assembled corrugated skid of FIG. 18 in accordance with the invention is shown in FIG. 19. The skid 310 has the three top blank ribs 314, 315, 316 intersecting and nesting with the three bottom blank ribs 321, 322, 323. Corner locking tabs 320 lock with corner locking receptacles 328, 332. Tray sidewalls provide lateral support against shifting of a shipping load, not shown. Forklift notches 333 allow for lifting with forklifts and fork passages allow for lifting with forklifts or pallet jacks.

The top tray arrangement could also be achieved by folding extensions on opposite sides of the top and bottom blanks to form the four sides of the tray and fastening the corners together, thereby obviating the need for the third blank, in skid designs where the additional blank is not needed for the extra load capacity of the upper deck layers.

Figure 20A:
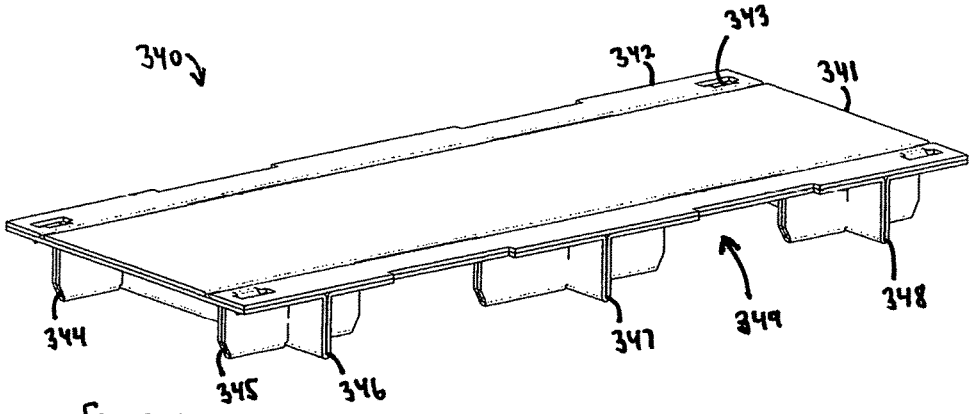
FIGS. 20A and 20 B are isometric drawings of an alternate configuration corrugated skid in accordance with the invention.
Figure 20B:
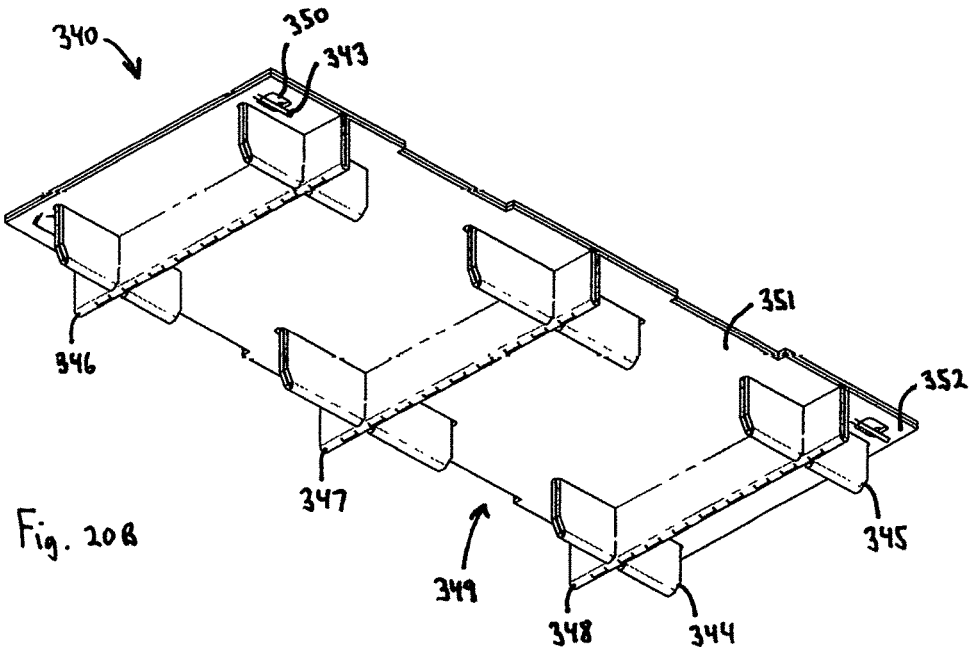

Isometric drawings of an alternate configuration corrugated skid in accordance with the invention are shown in FIG. 20A and 20 B. Although the skids shown so far have included three top ribs and three bottom ribs, half skids can also be constructed using three ribs and two ribs. The skid 340 comprises two rows of upper blank ribs 344, 345 folded adjacent top blank deck sections 341, 342. The skid also comprises three rows of lower blank ribs 346, 347, 348 folded adjacent deck panels 351, 352. Corner locking tabs 343 penetrate and lock into corner locking receptacles 350. Other locking means could also be used as long as they helped hold the blanks together and helped resist opening of outer bottom ribs 346, 348. Fork passages 349 allow for lifting by forklift or pallet jack. In some circumstances, lifting by forklift is all that may be required and in these cases the height of the skid may be appropriately reduced.

Figure 21A:
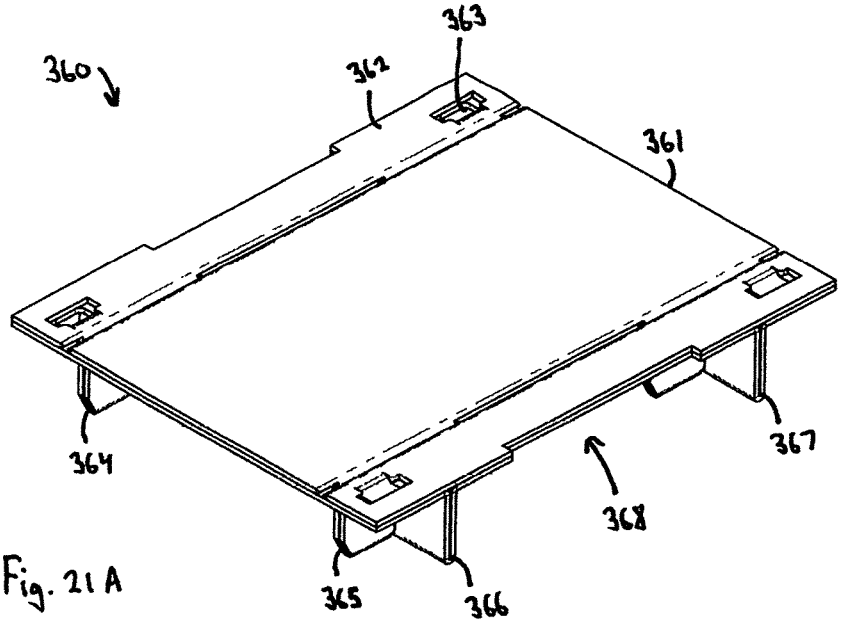
FIGS. 21A and 21 B are isometric drawings of an alternate configuration corrugated skid in accordance with the invention.
Figure 21B:
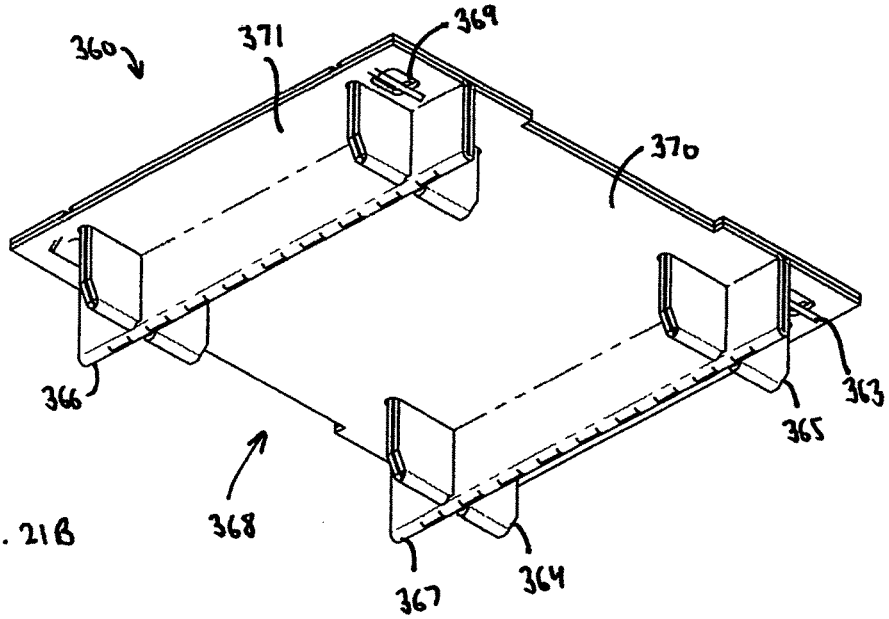

Isometric drawings of an alternate configuration corrugated skid in accordance with the invention are shown in FIGS. 21A and 21 B. The skids of the invention may also be used to create quarter skids. The quarter skid 360 utilizes two rows of upper blank ribs 364, 365 and intersects them with two rows of low blank ribs 366, 367. The top blank is folded to produce deck panels 361, 362. The bottom blank is folded to produce deck panels 370, 371. Corner locking tabs 363 lock with corner locking receptacles 369. Fork passage 370 allows for lifting and moving the skid 360.

Figure 22A:
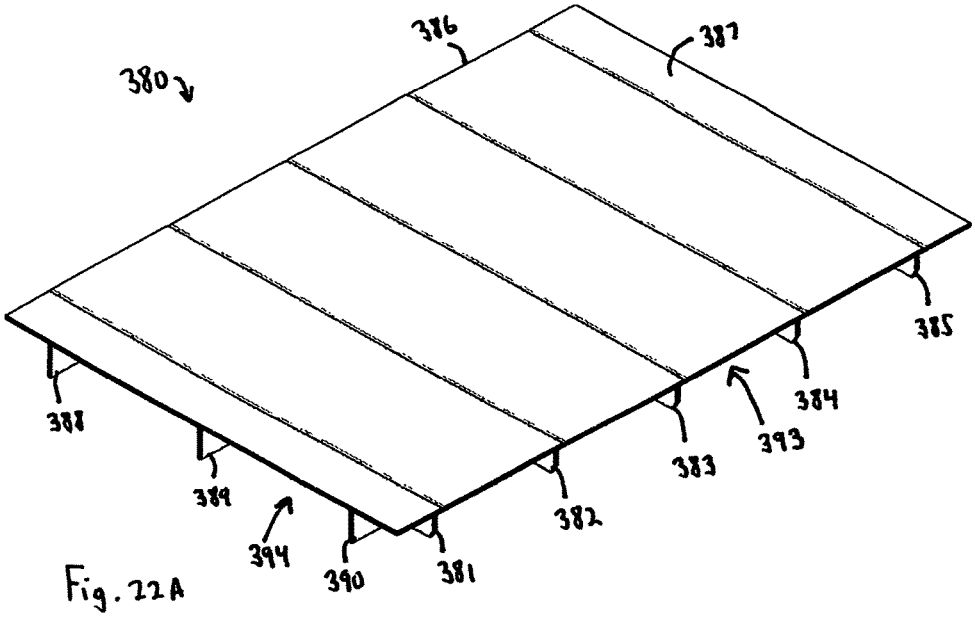
FIGS. 22A and 22 B are isometric drawings of an alternate configuration corrugated skid in accordance with the invention.
Figure 22B:
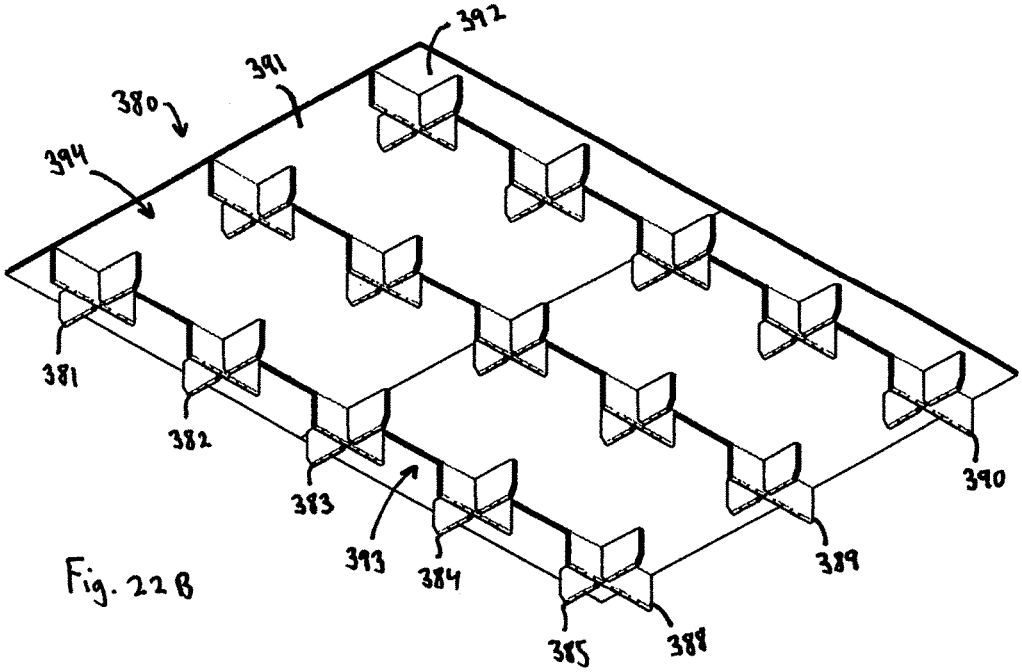

Isometric drawings of an alternate configuration corrugated skid in accordance with the invention are shown in FIG. 22A and 22 B. For very large and/or flexible loads, it can be desirable to use a skid with a high number of rib intersections as shown in this configuration. The skid 380 comprises top blank rib sections 381, 382, 383, 384, 385 and top blank deck panels 386, 387. The skid further comprises bottom blank rib sections 388, 389, 390 and bottom blank deck panels 390, 392. As shown, the skid allows full four way pallet jack or forklift access, depending on desired height, with fork passages 393, 394 in both directions.

Obviously, numerous modifications and variations of the described preferred embodiment are possible and will occur to those skilled in the art in light of this disclosure of the invention. Accordingly, I intend that these modifications and variations, and the equivalents thereof, be included within the spirit and scope of the invention as defined in the following claims.

I claim:

1. A skid for supporting a load above a supporting surface, formed from two corrugated blanks comprising a top blank and a bottom blank;

said blanks are folded and assembled together to form a deck having two deck layers, including an upper deck layer formed from said top blank, and a bottom deck layer formed from said bottom blank; multiple vertical extending top blank ribs that are comprised of at least two top blank layers, and multiple vertical extending bottom blank ribs that are comprised of at least two bottom blank layers;

said top blank ribs and said bottom blank ribs comprise notches having a width that allows said notches to interlock each other perpendicularly upon vertically assembly together;

said top blank ribs are separated into multiple top blank rib sections;

said bottom deck layer formed from said bottom blank has multiple bottom blank deck slots;

on vertical assembly of said two deck layers to form said skid, said multiple top blank rib sections penetrate through said bottom blank by way of said bottom blank deck slots, such that said ribs of said top blank and said bottom blank both extend below said deck and into position to engage said supporting surface; and said bottom blank deck slots have a greater width than said width of said notches of said bottom blank, and said notches of said bottom blank are sized to tightly engage said top blank ribs to hold said top blank ribs from spreading open when said top and bottom blanks are vertically assembled.

2. A skid defined in claim 1 wherein:

said two deck layers each have a top face and a bottom face, said top face of said bottom blank being oriented to face said bottom face of said top blank, and said two deck layers being fastened together face-to-face at locations away from where said top blank ribs penetrate said bottom blank, such that relative sliding translation between said two deck layers is restricted and bend shear displacement is reduced between said deck layers at said locations.

3. A skid defined in claim 2 wherein:

said two deck layers are fastened together by a mechanical lock that includes a plurality of lock receptacles in said bottom blank, and a plurality of locking tabs in said top blank that are aligned with corresponding positions of said lock receptacles in said bottom blank when said ribs have been formed and said blanks are aligned for assembly;

said tabs engage said bottom blank around margins of said lock receptacles when said tabs are pushed through said lock receptacles after said ribs of said top and bottom blanks have nested, with said notches interlocked;

whereby said locking tabs hold said top and bottom blanks together face-to-face against bend shear displacement after said tabs have been pushed through said receptacles.

4. A skid defined in claim 1 wherein:

said two deck layers each have a top face and a bottom face, said top face of said bottom blank being oriented to face said bottom face of said top blank, and said two deck layers being fastened together face-to-face by adhesive bonding between facing surfaces of said two deck layers such that relative sliding translation between said two deck layers is restricted and bending shear displacement between said deck layers is reduced, including areas away from locations adjacent said top blank ribs.

5. A skid defined in claim 4 wherein:

said top blank ribs each have exactly two top blank rib layers, and said top blank layers each fold vertically with only a single rib crest fold line that rests on a supporting surface between adjacent sections of said deck that are elevated above said supporting surface said bottom blank ribs each have exactly two bottom blank rib layers, and said bottom blank rib layers each fold vertically with only a single crest fold line that rests on a supporting surface between adjacent sections of said deck that are elevated above said supporting surface.

6. A skid defined in claim 1 wherein:

tray sides extend up from peripheral edges of said deck to provide lateral support against shifting of loads on said skid.

7. A skid defined in claim 1 wherein said skid further comprises:

an intermediate layer of material between facing surfaces of said two deck layers for increasing said bending stiffness of said deck.

8. A skid formed from two corrugated blanks comprising a top blank and a bottom blank;

said blanks are folded and assembled together to form two deck layers, multiple vertically extending top blank ribs that are comprised of at least two top blank layers, and multiple vertically extending bottom blank ribs that are comprised of at least two bottom blank layers;

said top blank ribs are each formed by folding said top blank along two parallel top blank rib root fold lines and a single top blank top rib crest fold line, and said bottom blank ribs are each formed by folding said bottom blank along two parallel bottom blank rib root fold lines and a single bottom blank bottom rib crest fold line;

said top blank ribs and said bottom blank ribs each comprise notches that interlock each other perpendicularly upon vertically assembly together;

said top blank ribs are separated into multiple top blank rib sections;

said bottom blank has multiple slots that are dimensioned to freely receive said top blank ribs when said blanks are folded and assembled together, said bottom blank slots run perpendicular to and end at said bottom blank rib root fold lines, and have narrower extensions that form said bottom blank notches, said bottom blank notches extend across said bottom blank rib root fold lines and terminate short of said bottom blank rib crest fold fines whereby, on assembly, said- top blank ribs freely penetrate said bottom blank slots, and said narrower width notches in said top and bottom ribs engage said bottom and top ribs, respectively, to hold said bottom and top ribs securely against spreading open.

9. A skid defined in claim 8 wherein:

fork passages under said skid are provided by having openings in said top blank ribs at locations aside of where said top blank ribs penetrate said bottom blank deck slots.

10. A skid defined in claim 8 wherein:

said top blank ribs each comprise only two top rib blank layers, and said top rib blank layers fold vertically with only a single crest fold line that rests upon the ground between adjacent sections of said deck layer formed from said top blank;

said bottom blank ribs each comprise only two bottom rib blank layers and said bottom rib blank layers fold vertically with only a single crest fold line that rests upon the ground between adjacent sections of said upper deck layer formed from said bottom blank;

said two deck layers are fastened together by a mechanical lock that includes a plurality of lock receptacles in said bottom blank, and a plurality of locking tabs in said top blank that are aligned with corresponding positions of said lock receptacles in said bottom blank when said ribs have been formed and said blanks are aligned for assembly;

said tabs engage said bottom blank around margins of said lock receptacles when said tabs are pushed through said lock receptacles after said ribs of said top and bottom blanks have nested, with said notches interlocked;

whereby said locking tabs hold said top and bottom blanks together face-to-face against bend shear displacement after said tabs have been pushed through said receptacles.

11. A skid defined in claim 10 wherein:

said two deck layers are fastened by said mechanical locking near corners of said skid.

12. A skid defined in claim 8 wherein:

said two deck layers are fastened together face-to-face by adhesive bonding between facing surfaces of said deck layers, such that bending shear displacements between said deck layers formed by said top blank and said bottom blank are reduced at locations offset from said top blank ribs.

13. A skid defined in claim 8 wherein:

said skid comprises an intermediate layer of material that is located vertically between said two deck layers formed by said top blank and said bottom blank.

14. The corrugated skid defined in claim 8, wherein:

tray sides extend up from peripheral edges of said deck to provide lateral support against shifting of loads on said skid.

15. A skid formed from two corrugated blanks comprising a top blank and a bottom blank;

said blanks are folded and assembled together to form a deck having a top load bearing side and a bottom downwardly facing side, said deck having two deck layers, including an upper deck layer formed from said top blank, and a lower deck layer formed from said bottom blank, multiple downwardly extending top blank ribs that are comprised of at least two blank layers, and multiple downwardly extending bottom blank ribs that are comprised of at least two blank layers;

said top blank ribs and said bottom blank ribs comprise notches that interlock each other perpendicularly upon vertically assembly together;

said top blank ribs are separated into multiple top blank rib sections;

said lower deck layer has multiple bottom blank deck slots;

said multiple top blank rib sections penetrate said bottom blank deck slots such that both said top blank ribs and said bottom blank ribs extend below both of said blanks and support said deck above a supporting surface, and said bottom blank deck slots have a width that is greater than the width of said notches of said bottom blank, whereby said top blank rib sections easily penetrate said slots, and said notches engage each other tightly to hold said ribs together securely.

16. A skid defined in claim 15 wherein:

said top blank ribs each comprise only two top rib blank layers and said top rib blank layers fold vertically with only a single crest fold line that rests upon the ground between adjacent sections of said upper deck layer formed from said top blank;

and said bottom blank ribs each comprise only two bottom rib blank layers and said bottom rib blank layers fold vertically with only a single crest fold line that rests upon the ground between adjacent sections of said upper deck layer formed from said bottom blank.

17. A skid defined in claim 15 wherein:

said two upper deck layers are fastened together by adhesive between said upper deck layers that reduces bending shear displacement between said upper deck layers across the surface including areas away from locations of said top blank ribs.

18. The corrugated skid defined in claim 15, wherein:

said notches in said bottom blank are extensions of said slots, having a narrower width than said slots, whereby said bottom blank is folded to produce said bottom blank ribs and is vertically assembled with said top blank, said top blank ribs penetrate said bottom blank deck slots with a looser fit than said notches that interlock each other perpendicularly.

19. The corrugated skid defined in claim 15, wherein:

said two upper deck layers are fastened together by mechanical locking that resists opening of the outermost of said bottom blank ribs through shear.

20. The corrugated skid defined in claim 15, wherein:

peripheral ends of said top blank ribs and or said bottom blank ribs are angled so that said deck overhangs ends of said ribs at points where said ribs contact a supporting surface when said skid is supported by said supporting surface, to avoid interference with devices for securing said skid and a load thereon, thereby to facilitate use for air cargo shipping.

* * * * *